US010507673B2

(12) United States Patent
Yoshida

(10) Patent No.: US 10,507,673 B2
(45) Date of Patent: Dec. 17, 2019

(54) MOUNT FOR STICKING STICKY NOTE THERETO AND MEDIUM STORING PROGRAM EXECUTABLE BY CONTROLLER

(71) Applicant: BROTHER KOGYO KABUSHIKI KAISHA, Nagoya-shi, Aichi-ken (JP)

(72) Inventor: Yasunari Yoshida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/440,537

(22) Filed: Feb. 23, 2017

(65) Prior Publication Data

US 2017/0246883 A1 Aug. 31, 2017

(30) Foreign Application Priority Data

Feb. 26, 2016 (JP) ..... 2016-035506

(51) Int. Cl.
*B41J 3/407* (2006.01)
*B41J 29/40* (2006.01)
(Continued)

(52) U.S. Cl.
CPC ..... *B41J 3/4075* (2013.01); *B41J 2/15* (2013.01); *B41J 11/005* (2013.01); *B41J 11/36* (2013.01); *B41J 29/40* (2013.01); *B42D 5/003* (2013.01)

(58) Field of Classification Search
CPC ..... B41J 3/407
See application file for complete search history.

(56) References Cited

U.S. PATENT DOCUMENTS 5,782,494 A * 7/1998 Crandall ..... B42D 5/003 281/12
2004/0155924 A1* 8/2004 Mitsuzawa ..... B41J 2/2135 347/40

(Continued)

FOREIGN PATENT DOCUMENTS

JP 3467691 B2 11/2003
JP 2007-204265 A 8/2007

(Continued)

OTHER PUBLICATIONS

Chinese Office Action dated Sep. 29, 2019 in Chinese Patent Application No. 201710089365.X.

*Primary Examiner* — Shelby L Fidler
(74) *Attorney, Agent, or Firm* — Scully, Scott, Murphy & Presser, PC

(57) ABSTRACT

A non-transitory computer-readable medium storing programs executable by a controller that causes a print execution device to execute printing is provided. The print execution device includes: a print head provided with nozzles aligned in a sub scanning direction; a holding member which holds a part of a printing medium conveyed in the sub scanning direction; and a head driving device which causes the print head to execute a main scanning operation. The programs cause the controller to execute: a first acquiring process for acquiring first object data which represents a first object image to be printed on a first sticky note; a generating process for generating printing data for the print execution device to execute the printing of the first object image on the first sticky note by utilizing the first object data; and a supply process for supplying the printing data to the print execution device.

10 Claims, 14 Drawing Sheets

(51) Int. Cl.

| | |
|---|---|
| ***B41J 11/36*** | (2006.01) |
| ***B42D 5/00*** | (2006.01) |
| ***B41J 2/15*** | (2006.01) |
| ***B41J 11/00*** | (2006.01) |

(56) References Cited

U.S. PATENT DOCUMENTS

| | | | | |
|---|---|---|---|---|
| 2006/0198979 | A1* | 9/2006 | McConkie | B41J 13/16 428/42.3 |
| 2008/0047971 | A1* | 2/2008 | Sakano | B41J 13/103 221/282 |
| 2015/0035891 | A1* | 2/2015 | Yoshida | B41J 11/005 347/16 |

FOREIGN PATENT DOCUMENTS

| | | | |
|---|---|---|---|
| JP | 3969023 | B2 | 8/2007 |
| JP | 2008-102723 | A | 5/2008 |
| JP | 4894830 | B2 | 3/2012 |

* cited by examiner

Fig. 9

(FIRST EMBODIMENT)
(FIRST ROW)

DETERMINE n AT WHICH FL ≤ PL*n + UM ... EXPRESSION (1) HOLDS.

POSITION OF PL*n + UM FROM STARTING POINT SA1 IS DETERMINED AS UPSTREAM END A1 OF STICKY NOTE STICKING AREA IN FIRST ROW.

(SECOND EMBODIMENT: GENERATE PATH LEADING DATA)
(THIRD EMBODIMENT: GENERATE PATH LEADING DATA + SKIP PREVENTION DATA)

FL: LENGTH OF STICKY NOTE FS IN SUB SCANNING DIRECTION ... 75 mm
PL: CONVEYANCE AMOUNT FOR EACH 1 PATH (N NOZZLE PITCHES) ... 35 mm
UM: HOLDING LENGTH BY CORRUGATED PLATE 70 ... 10 mm
n: NUMBER OF PATHS (NUMBER OF TIMES OF MAIN SCANNING OPERATION) ... 2

(EXEMPLARY CALCULATION)
LEFT SIDE FL = 75
RIGHT SIDE PL*n + UM = 80
POSITION OF 80 mm FROM STARTING POINT SA1 IS DETERMINED AS A1.

LENGTH IN SUB SCANNING DIRECTION OF ARRANGEMENT AREA D CAPABLE OF ARRANGING PRINTING AREA R IS FL - UM = 65.

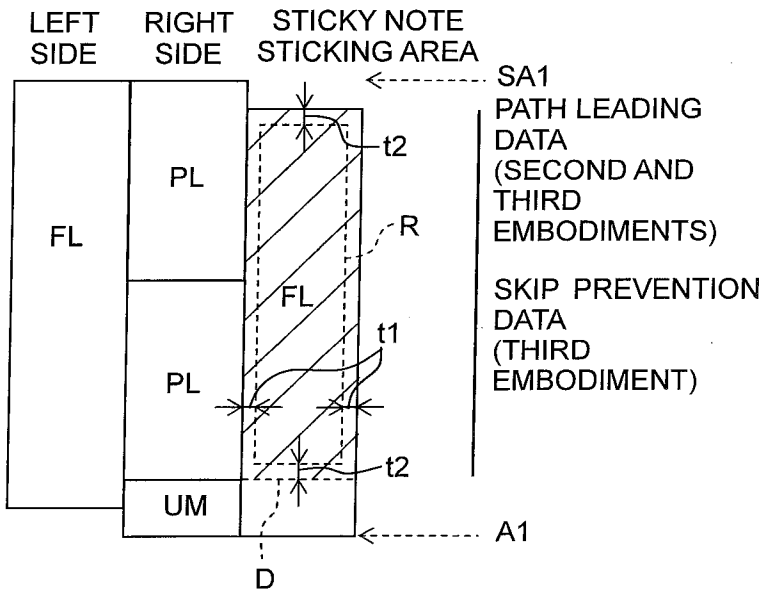

Fig. 10

(FIRST EMBODIMENT)
(SECOND ROW)

DETERMINE m AT WHICH PL*n + UM + (FL + SL) ≤ PL*m + UM ... EXPRESSION (2-1) HOLDS.

POSITION OF PL*m + UM FROM STARTING POINT SA1 IS DETERMINED AS UPSTREAM END A2 OF STICKY NOTE STICKING AREA IN SECOND ROW.

SL: MINIMUM SPACE BETWEEN STICKY NOTES FS
SL = PL*(n + 1) - (PL*n + UM) ... EXPRESSION (2-2)
SL IS NOT LESS THAN SM.
SM = MARGIN OF CARRIAGE (EXEMPLARY CALCULATION)
FL: LENGTH OF STICKY NOTE FS IN SUB SCANNING DIRECTION ... 75 mm
PL: CONVEYANCE AMOUNT FOR EACH 1 PATH (N NOZZLE PITCHES) ... 35 mm
UM: HOLDING LENGTH BY CORRUGATED PLATE 70 ... 10 mm

SL = PL*(n + 1) - (PL*n + UM) = 25
m = 5

LEFT SIDE PL*n + UM + (FL + SL) = 180
RIGHT SIDE PL*m + UM = 185
POSITION OF 185 mm FROM STARTING POINT SA1 IS DETERMINED AS A2.

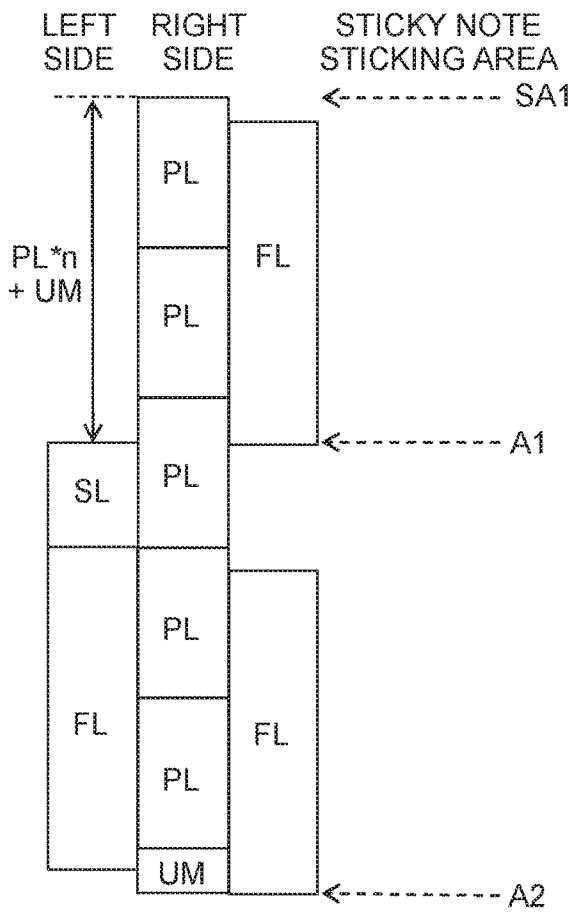

Fig. 11A
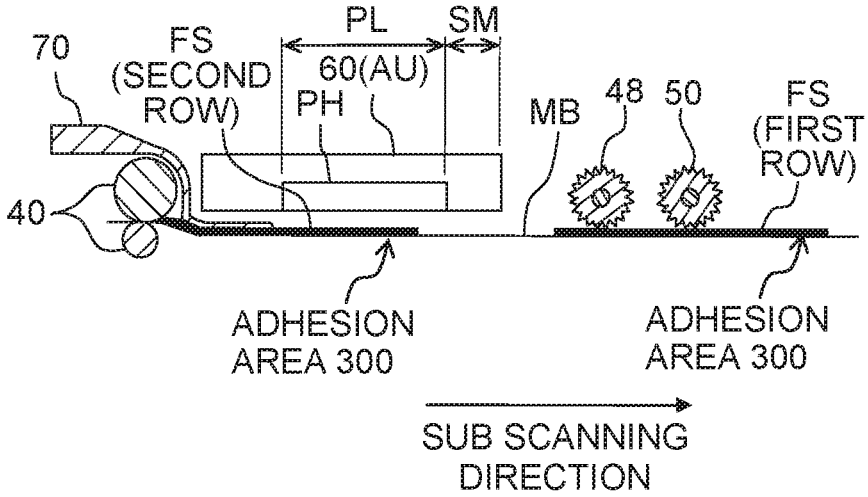
*FIRST ROW AND SECOND ROW ARE REQUIRED TO BE SEPARATED BY AT LEAST SM.
Fig. 11B (COMPARATIVE EXAMPLE)
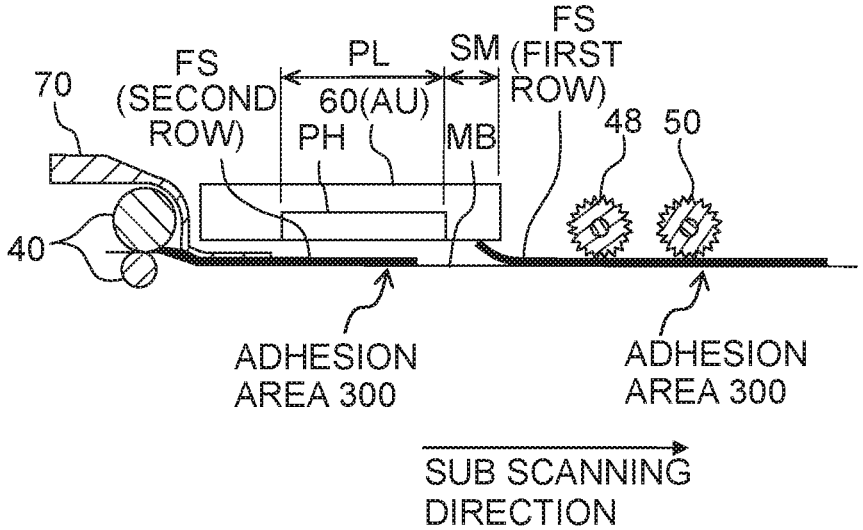

Fig. 12

(THIRD EMBODIMENT)
(SECOND ROW)

STARTING POINT SB2 IS NEWLY DETERMINED.
SB2 IS ARBITRARY POSITION SEPARATED FROM A1 BY NOT LESS THAN SM.

DETERMINE n AT WHICH FL ≤ PL*n + UM ... EXPRESSION (3) HOLDS.

POSITION, WHICH IS SEPARATED BY PL*n + UM FROM STARTING POINT SB2, IS DETERMINED AS UPSTREAM END B2 OF STICKY NOTE STICKING AREA IN SECOND ROW.
IN THIS PROCEDURE, PATH LEADING DATA AND SKIP PREVENTION DATA ARE ADDED.

(EXEMPLARY CALCULATION)
FL: LENGTH OF STICKY NOTE FS IN SUB SCANNING DIRECTION ... 75 mm
PL: CONVEYANCE AMOUNT FOR EACH 1 PATH (N NOZZLE PITCHES) ... 35 mm
UM: HOLDING LENGTH BY CORRUGATED PLATE 70 ... 10 mm
n: NUMBER OF PATHS (NUMBER OF TIMES OF MAIN SCANNING OPERATION) ... 2
SM: MARGIN OF CARRIAGE ... 5 mm

LEFT SIDE FL = 75
RIGHT SIDE PL*n + UM = 80
-> POSITION OF 80 mm FROM STARTING POINT SB2 IS DETERMINED AS C2.

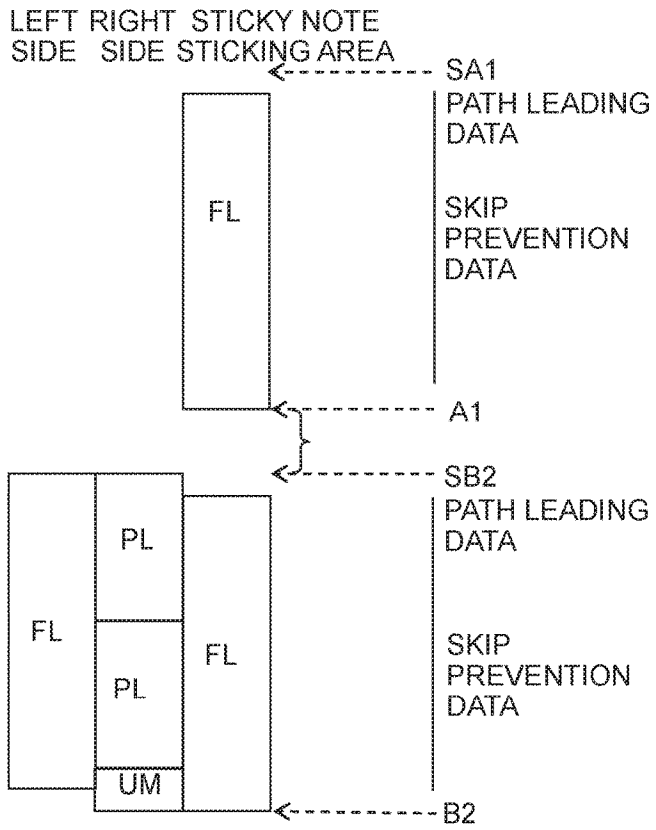

(FOURTH EMBODIMENT)
(FIRST ROW)

DETERMINE i AT WHICH
FL ≤ RL*i + TL*(i - 1) + UM ...
EXPRESSION (4) HOLDS.

POSITION, WHICH IS SEPARATED
FROM STARTING POINT SC1 BY
RL*i + TL*(i - 1) + UM, IS DETERMINED
AS UPSTREAM END C1 OF STICKY
NOTE STICKING AREA IN FIRST ROW.

RL: LENGTH OF LARGE OVERLAP RANGE
TL: LENGTH OF SMALL OVERLAP RANGE

MOUNT FOR STICKING STICKY NOTE THERETO AND MEDIUM STORING PROGRAM EXECUTABLE BY CONTROLLER

CROSS REFERENCE TO RELATED APPLICATION

The present application claims priority from Japanese Patent Application No. 2016-035506, filed on Feb. 26, 2016, the disclosure of which is incorporated herein by reference in its entirety.

BACKGROUND

Field of the Invention

The present invention relates to such a technique that a print execution device conveys a mount (mounting sheet) to which a sticky note is stuck and executes printing on the sticky note.

Description of the Related Art

A sticky note (post-it note) printer for executing printing on a sticky note is known. The sticky note printer is provided with a setting section for setting a sticky note bundle, sticky note feeding means for taking off one sheet of sticky note of the sticky note bundle and then feeding the sticky note while peeling off a paste portion of the sticky note, and printing means for performing printing on the fed sticky note.

SUMMARY

In order to perform printing on a sticky note, it has been necessary to prepare any exclusively usable sticky note printer as described above. An object of the present teaching is to provide such a technique that a print execution device is allowed to appropriately execute printing on a sticky note even when the print execution device is not provided with any exclusively usable construction for performing the printing on the sticky note.

According to a first aspect of the present teaching, there is provided a non-transitory computer-readable medium storing programs executable by a controller that causes a print execution device to execute printing, the print execution device including: a print head provided with nozzles aligned in a sub scanning direction; a holding member which holds a part of a printing medium conveyed from an upstream side toward a downstream side in the sub scanning direction; and a head driving device which causes the print head to execute a main scanning operation, the main scanning operation including an operation for causing the print head to discharge an ink toward the printing medium while moving the print head in a main scanning direction orthogonal to the sub scanning direction, the programs causing the controller to execute: a first acquiring process for acquiring first object data which represents a first object image to be printed on a first sticky note; a generating process for generating printing data for the print execution device to execute the printing of the first object image on the first sticky note by utilizing the first object data; and a supply process for supplying the printing data to the print execution device, wherein the first sticky note is conveyed by the print execution device in a state of being stuck on a mount, the printing data represents a printing image in which the first object image is arranged in a first predetermined area, and the first predetermined area is an area, in which the main scanning operation can be executed by the print head to print the first object image on the first sticky note in such a state that the holding member holds a part of the first sticky note, and in which the main scanning operation cannot be executed by the print head to print the first object image on the first sticky note in such a state that the holding member does not hold the first sticky note.

The programs stored on the medium can realize the following controller. That is, the controller can control the printing execution device so that the print head executes the main scanning operation to print the first object image on the first sticky note in the state in which the holding member holds the part of the first sticky note, and the print head does not execute the main scanning operation in the state in which the holding member does not hold the first sticky note. Therefore, the print execution device can execute the discharge of the ink onto the first sticky note in a state in which the first sticky note is not curled. On this account, even when the print execution device is not provided with any exclusively usable construction for performing the printing on the sticky note, it is possible to cause the print execution device to appropriately execute the printing on the sticky note.

According to a second aspect of the present teaching, there is provided a mount for sticking a sticky note on which printing is executed by a print execution device, the print execution device including: a print head provided with nozzles aligned in a sub scanning direction; a holding member which holds a part of a printing medium conveyed from an upstream side toward a downstream side in the sub scanning direction; and a head driving device which causes the print head to execute a main scanning operation, the main scanning operation including an operation for causing the print head to discharge an ink toward the printing medium while moving the print head in a main scanning direction orthogonal to the sub scanning direction, the mount comprising a guide image for indicating a sticking position at which the sticky note is to be stuck, the sticky note having a first sticky note end portion which has an adhesion area and a second sticky note end portion which is disposed on a side opposite to the first sticky note end portion in the sub scanning direction, wherein the sticking position is determined so that: the mount is conveyed in the sub scanning direction by the print execution device in a state in which the sticky note is stuck such that the first sticky note end portion is positioned on the downstream side in the sub scanning direction and the second sticky note end portion is positioned on the upstream side in the sub scanning direction; and the main scanning operation can be executed by the print head to discharge the ink toward the sticky note in such a state that the holding member holds a part of the sticky note, and the main scanning operation cannot be executed by the print head to discharge the ink toward the sticky note in such a state that the holding member does not hold the sticky note.

According to this construction, if a user sticks the sticky note at the sticking position indicated by the guide image included in the mount, and the user sets the mount to the print execution device, then it is possible to realize the printing on the sticky note. In this case, the sticking position is determined so that the main scanning operation can be executed to discharge the ink toward the sticky note in the state in which the holding member holds the part of the sticky note, and that the main scanning operation cannot be executed in the state in which the holding member does not hold the sticky note. Therefore, the print execution device can execute the discharge of the ink onto the sticky note in a state in which the sticky note is not curled. On this account, even when the print execution device is not provided with any exclusively usable construction for performing the printing on the sticky note, it is possible to cause the print execution device to appropriately execute the printing on the sticky note.

The foregoing controller itself, a control method for realizing the controller, and a computer readable recording medium storing the computer program are also novel and useful. Further, a print system, which is provided with the controller and the print execution device described above, is also novel and useful.

BRIEF DESCRIPTION OF THE DRAWINGS

FIG. 9 explains a method for determining a sticky note sticking area in a first row in a first embodiment.

FIG. 10 explains a method for determining a sticky note sticking area in a second row in the first embodiment.

FIGS. 11A and 11B explain positional relationship between a carriage and a sticky note.

FIG. 12 explains a method for determining a sticky note sticking area in a second row in a third embodiment.

DESCRIPTION OF THE EMBODIMENTS

[First Embodiment]<Construction of Print System 2>

Figure 1:
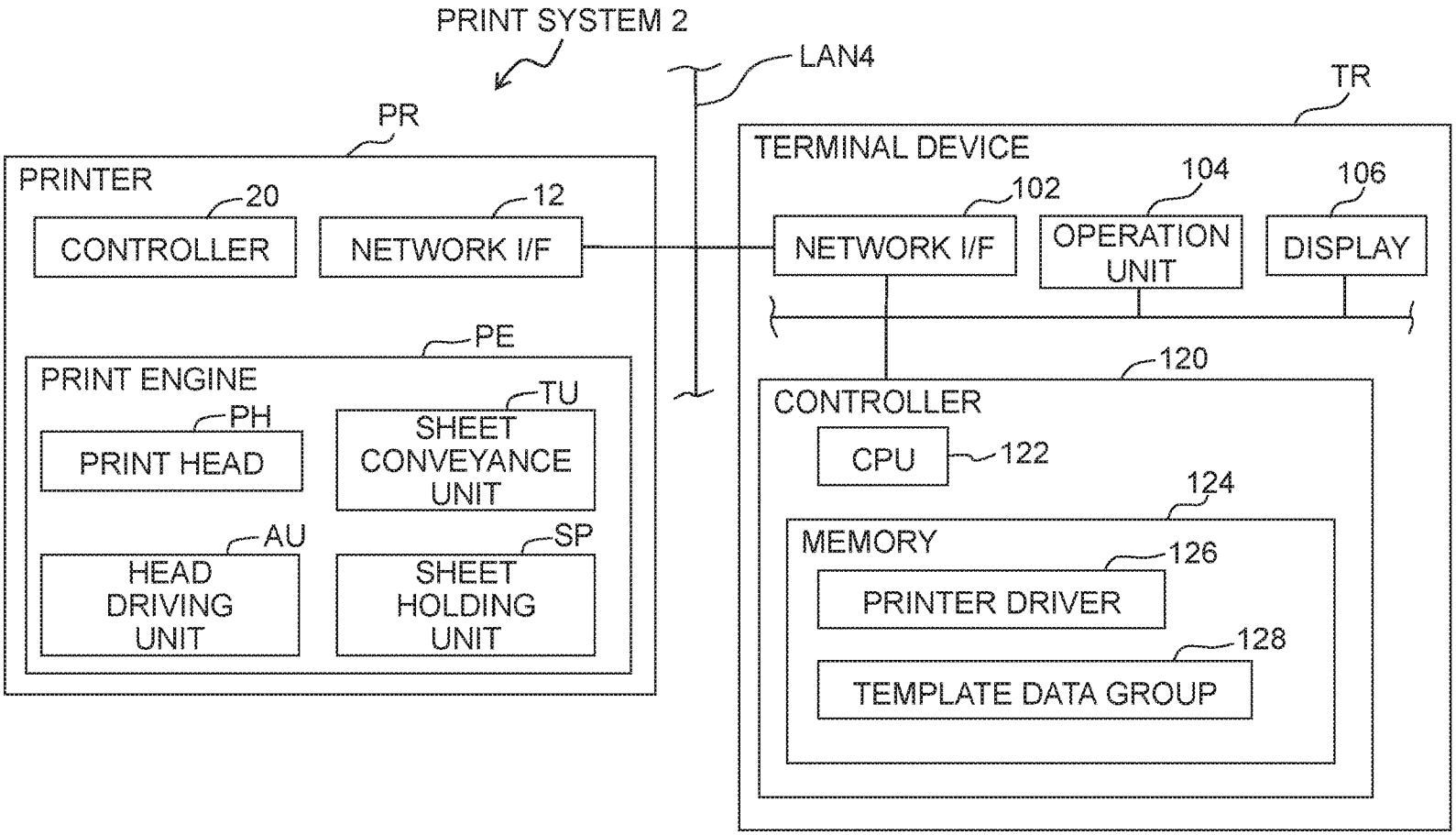
FIG. 1 depicts an arrangement of a print system.

As depicted in FIG. 1, a print system 2 is provided with a printer PR and a terminal device TR. The printer PR and the terminal device TR can make communication with each other via LAN 4.

<Construction of Printer PR>

The printer PR includes a network interface 12, a controller 20, and a print engine PE. The interface will be hereinafter referred to as "I/F" in some cases. The network I/F 12 is connected to LAN 4. The controller 20 is provided with a CPU and a memory (not depicted) to execute various processes in order to cause the print engine PE to execute the printing. The print engine PE includes a print head PH, a head driving device AU, a sheet conveyance device TU, and a sheet holding device (sheet pressing device) SP.

<Construction of Print Engine PE>

Figure 2:
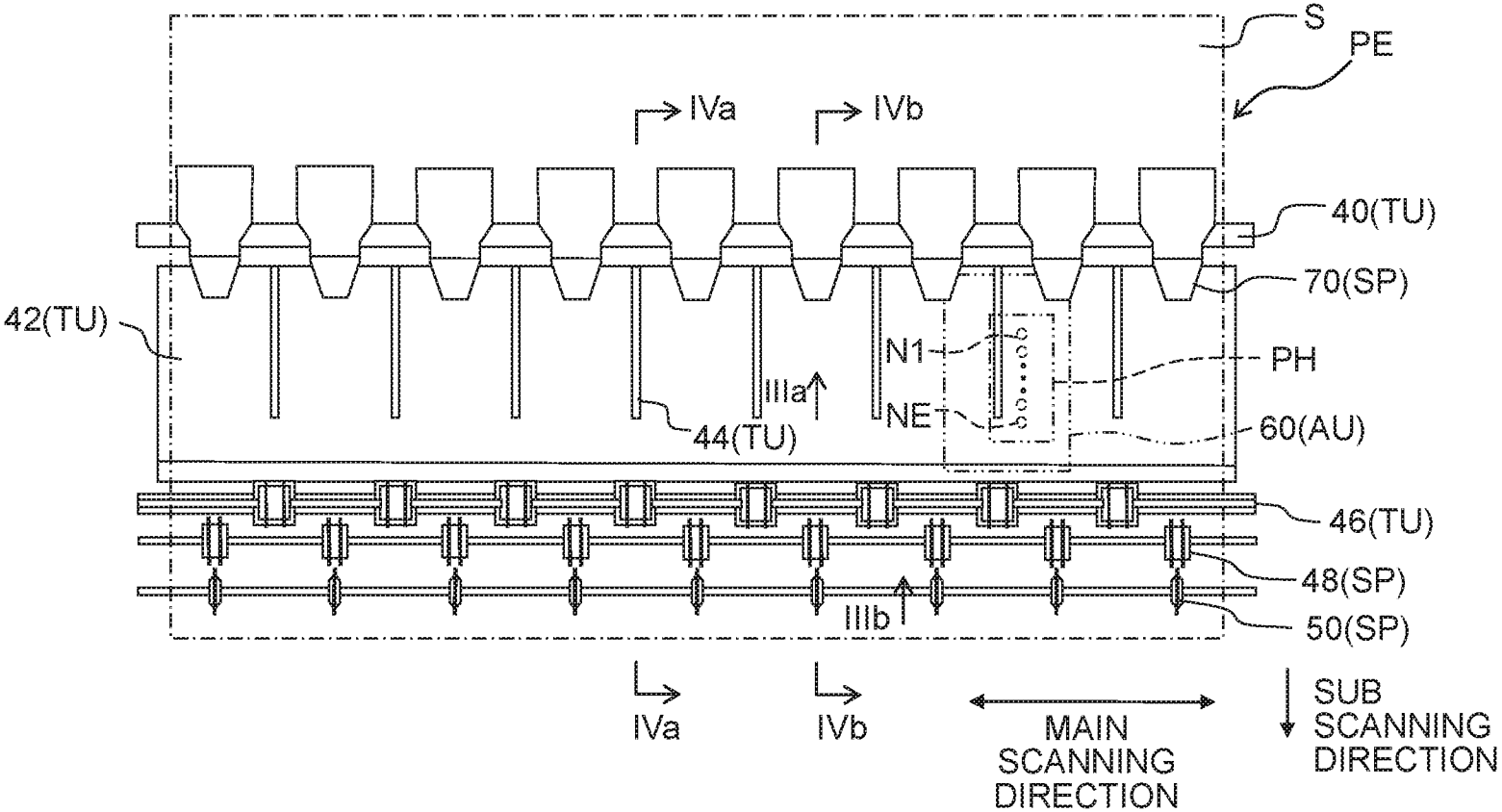
FIG. 2 depicts a plan view illustrating a print engine.

FIGS. 2 to 4 depict the construction of the print engine PE. FIG. 2 depicts a plan view illustrating a part of the print engine PE, which depicts, with broken lines, the position of the print head PH in the print engine PE. In FIG. 2, the left-right direction on the paper surface, in which the print head PH is moved when the printing is executed on a sheet S, is the main scanning direction. The downward direction on the paper surface, in which the sheet S is moved when the printing is executed on the sheet S, is the sub scanning direction. The main scanning direction is orthogonal to the sub scanning direction.

The print head PH is provided with a plurality of nozzles N1 to NE. The respective nozzles N1 to NE are aligned at equal intervals on a straight line in the sub scanning direction. The nozzle N1 and the nozzle NE are the nozzles which are arranged on the most upstream side and the most downstream side in the sub scanning direction respectively.

The head driving device AU is provided with a carriage 60. The print head PH is carried on the carriage 60. The head driving device AU further includes a driving circuit which is provided to drive the print head PH and a transport member which is provided to transport the carriage 60 (these components are not depicted). The driving circuit supplies the driving signal to the print head PH in accordance with the instruction of the controller 20. Accordingly, ink droplets are discharged from the respective nozzles N1, NE and the like provided in the print head PH. The transport member includes a motor, a belt, a pulley and the like (not depicted) to reciprocatively move the carriage 60 in the main scanning direction in accordance with the instruction of the controller 20.

In this embodiment, the print head PH discharges the ink toward the sheet S during the outward movement of one round of the reciprocating movement performed in the main scanning direction, but the print head PH does not discharge the ink toward the sheet S during the return path movement. In the following description, the operation, in which the print head PH discharges the ink while performing the outward movement, is referred to as "main scanning operation". Further, in the following description, the main scanning operation is simply referred to as "path" in some cases. In a modified embodiment, the print head PH may discharge the ink toward the sheet S during the outward movement of one round of the reciprocating movement performed in the main scanning direction, and the print head PH may discharge the ink toward the sheet S during the return path movement. In this case, the path is executed one time by discharging the ink while performing the outward movement by the print head PH, and the path is executed one time by discharging the ink while performing the return path movement by the print head PH.

Figure 4A:
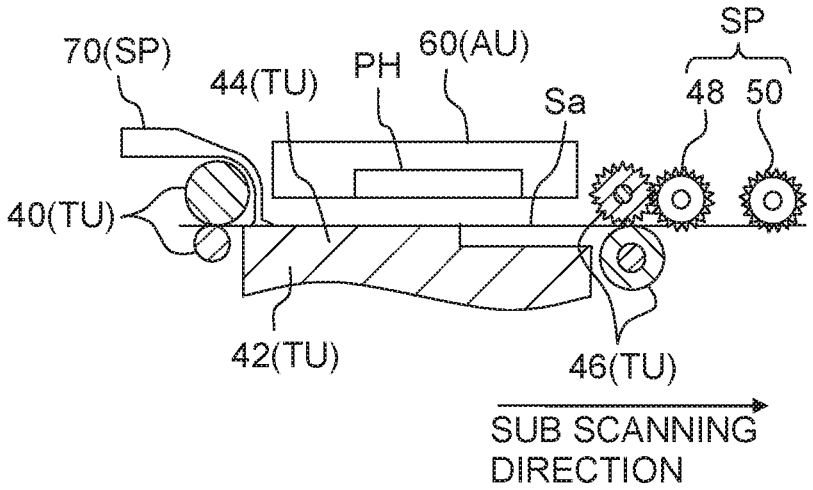
FIG. 4A depicts a sectional view taken along a line IVa-IVa depicted in FIG. 2.
Figure 4B:
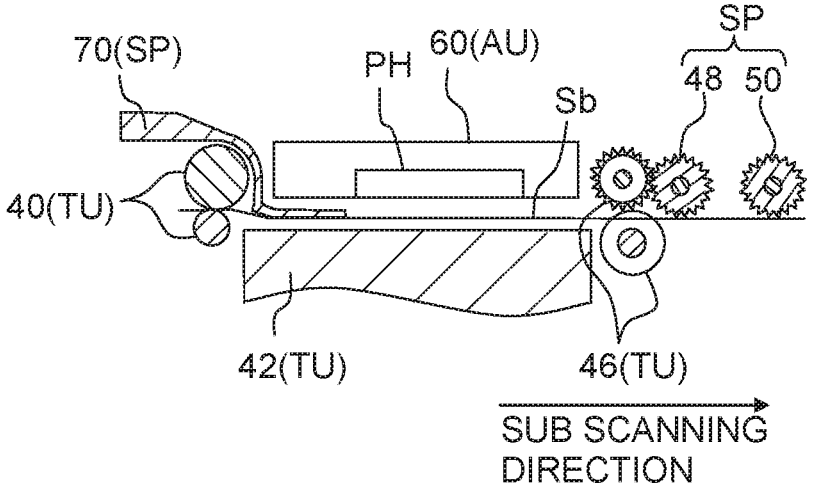
FIG. 4B depicts a sectional view taken along a line IVb-IVb depicted in FIG. 2.

The sheet conveyance device TU is provided with one paper feed roller pair 40, a platen 42, a plurality of ribs 44, and a plurality of paper discharge roller pairs 46. The paper feed roller pair 40 is constructed by a pair of rollers which are longer than the length of the sheet S in the main scanning direction. As depicted in FIGS. 4A and 4B, the paper feed roller pair 40 nips or interposes the sheet S to convey the sheet S in the sub scanning direction. The platen 42 is arranged to be opposed to the print head PH. The respective ribs 44 are constructed to extend upwardly from the upper surface of the platen 42. As depicted in FIG. 2, the respective ribs 44 are arranged at equal intervals in the main scanning direction. In the sub scanning direction, the positions of the end portions on the upstream side of the respective ribs 44 are coincident with the position of the end portion on the upstream side of the platen 42, and the positions of the end portions on the downstream side of the respective ribs 44 are disposed on the upstream side as compared with the position of the end portion on the downstream side of the platen 43.

The paper discharge roller pairs 46 are arranged at equal intervals in the main scanning direction. In particular, in the main scanning direction, the positions of the respective paper discharge roller pairs 46 are coincident with the positions of the respective ribs 44. As depicted in FIGS. 4A and 4B, each of the paper discharge roller pairs 46 is constructed by a pair of rollers to convey the sheet S in the sub scanning direction while interposing the sheet S.

Figure 3A:
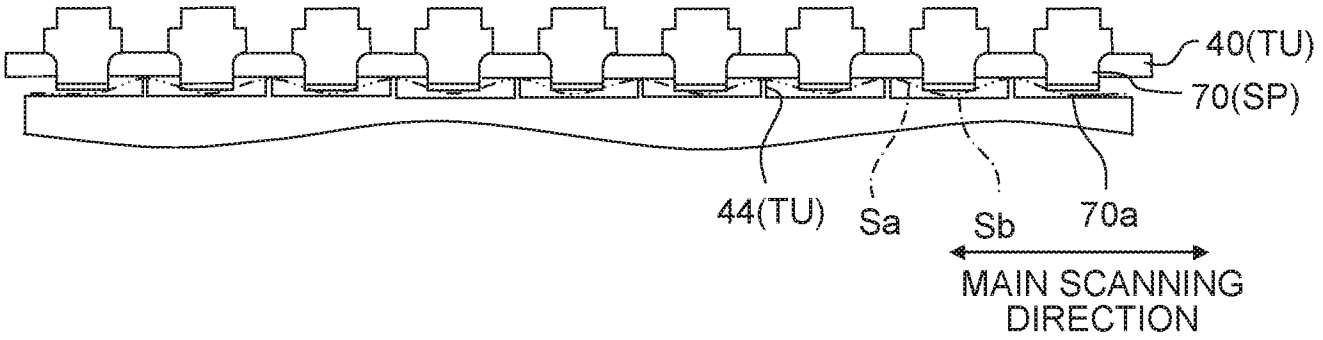
FIG. 3A depicts a view in which the print engine is viewed in a direction of an arrow IIIa depicted in FIG. 2.

The sheet holding device SP is provided with a plurality of corrugated plates 70 and a plurality of corrugated spurs 48, 50. As depicted in FIG. 2, the plates 70 are arranged at equal intervals in the main scanning direction. In particular, the positions of the plates 70 are different from the positions of the ribs 44 in the main scanning direction. That is, the plates 70 are arranged so that one plate 70 is positioned between the two adjoining ribs 44. As depicted in FIG. 3A, the lower surfaces of the respective plates 70 are positioned below the upper surfaces of the respective ribs 44. This situation is also depicted in FIGS. 4A and 4B.

Figure 3B:
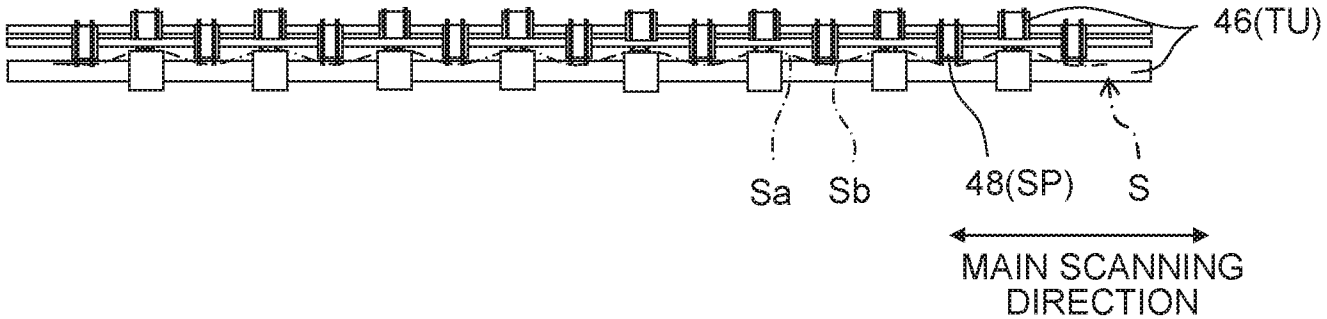
FIG. 3B depicts a view in which the print engine is viewed in a direction of an arrow IIIb depicted in FIG. 2.

As depicted in FIG. 2, the plurality of corrugated spurs 48 are arranged on the downstream side of the paper discharge roller pair 46 in the sub scanning direction. The plurality of corrugated spurs 50 are arranged on the further downstream side of the spurs 48. The spurs 48 and the spurs 50 are arranged at equal intervals in the main scanning direction. In particular, the positions of the spurs 48 and the positions of the spurs 50 are coincident with the positions of the corrugated plates 70 in the main scanning direction. As depicted in FIG. 3B, the lower ends of the respective spurs 48 are positioned below the upper ends of the lower side rollers of the paper discharge roller pair 46. This situation is also depicted in FIGS. 4A and 4B. Further, the respective spurs 50 are also positioned below the upper ends of the lower side rollers of the paper discharge roller pair 46.

In the case of the print engine PE constructed as described above, the head driving device AU allows the print head PH to execute the main scanning operation while the sheet conveyance device TU conveys the sheet S in the sub scanning direction, and thus it is possible to realize the printing on the sheet S. In particular, the sheet holding device SP is provided. Therefore, as depicted in FIGS. 3A and 3B, the sheet S is held or pressed from the upper positions by the corrugated plates 70 and the corrugated spurs 48, 50, and the sheet S is bent by being supported from the lower positions by the ribs 44. Accordingly, the sheet S is deformed into such a wavy shape that protrusion portions Sa which protrude in the direction (i.e., in the upward direction) to make approach to the print head PH and recess portions Sb which protrude in the direction (i.e., in the downward direction) to make separation from the print head PH are alternately aligned in the main scanning direction. Owing to the deformation of the sheet S into the wavy shape as described above, the both end portions in the sub scanning direction of the sheet S are prevented from floating upwardly (i.e., the sheet S is prevented from being curled in the sub scanning direction) between the paper feed roller pair 40 and the paper discharge roller pair 46. Accordingly, the print head PH, which is arranged between the paper feed roller pair 40 and the paper discharge roller pair 46, can discharge the ink toward the portion of the sheet S which is not curled in the sub scanning direction. As a result, the ink can be appropriately landed on the objective position.

<Construction of Terminal Device TR>

As depicted in FIG. 1, the terminal device TR includes a network I/F 102, an operation device 104, a display 106, and a controller 120. The network I/F 102 is connected to LAN 4. The operation device 104 is provided with a mouse and a keyboard. The user can input various instructions into the terminal device TR by operating the operation device 104. The display 106 is a display which is provided to display various screens.

The controller 120 is provided with CPU 122 and a memory 124. CPU 122 executes various processes in accordance with an OS program (not depicted), a printer driver 126 and the like stored in the memory 124. The printer driver 126 is a program which is provided to generate the printing data that represents the printing image as the printing object so that the printing data is supplied to the printer PR. For example, the printer driver 126 may be installed into the terminal device TR from a computer readable recording medium shipped together with the printer PR. Alternatively, the printer driver 126 may be installed into the terminal device TR from a server on the internet. The memory 124 further stores a template data group 128 which includes a plurality of types of template data. The template data group 128 is installed into the terminal device TR together with the printer driver 126. The template data group 128 is the data which is utilized in the sticky note printing process as described later on (see FIGS. 5A and 5B).

<Sticky Note Printing Process>

An explanation will be made with reference to FIGS. 5A and 5B about the contents of the sticky note printing process executed by CPU 122 in accordance with the printer driver 126. The sticky note printing process is the process which is performed in order that the printer PR is allowed to execute the printing on the sticky note stuck to a mount MB as described later on (see FIGS. 6 and 7). The user operates the operation device 104 to input a predetermined instruction in order to execute the sticky note printing process. In this procedure, CPU 122 starts the process depicted in FIGS. 5A and 5B.

In S10, CPU 122 stands by for the selection of the sticky note size. The user operates the operation device 104 to select a desired size from a plurality of types of sticky note sizes. In this procedure, CPU 122 determines that the sticky note size is selected (S10: YES), and CPU 122 executes S12. In this case, the plurality of types of the sticky note sizes include a first size (for example, a sticky note FS depicted in FIG. 6) and a second size (for example, a sticky note FS depicted in FIG. 7) which is different from the first size. The first size has, for example, a length of 75 mm and a width of 25 mm. The second size has, for example, a length of 50 mm and a width of 50 mm.

In S12, CPU 122 reads the template data (hereinafter referred to as "specified template data") corresponding to the sticky note size selected in S10, from the template data group 128 stored in the memory 124. Then, CPU 122 causes the display 106 to display a predetermined instruction screen in order to print the mount (see FIGS. 6 and 7) corresponding to the specified template data.

In S14, CPU 122 stands by for the input of the instruction in order to print the mount MB on the predetermined instruction screen. If the instruction is inputted by the user, CPU 122 determines that the mount printing instruction is inputted (S14: YES), and CPU 122 executes S16.

In S16, CPU 122 supplies, to the printer PR, the mount data which represents the mount image corresponding to the specified template data. As a result, the printer PR prints the mount image represented by the mount data, for example, on the sheet S having a predetermined size such as A4 or the like. Accordingly, the mount MB can be provided to the user.

Figure 6:
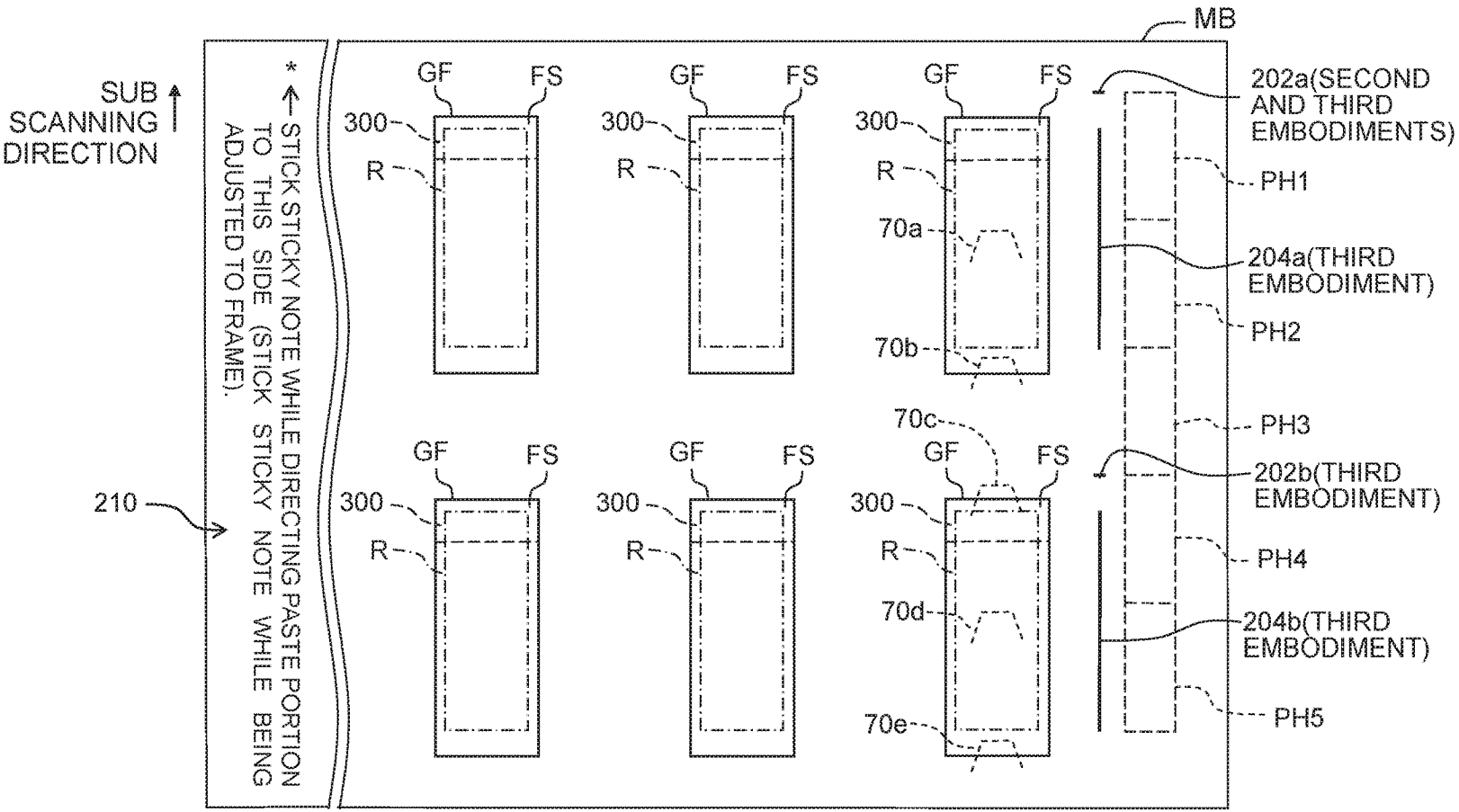
FIG. 6 explains an exemplary mount.
Figure 7:
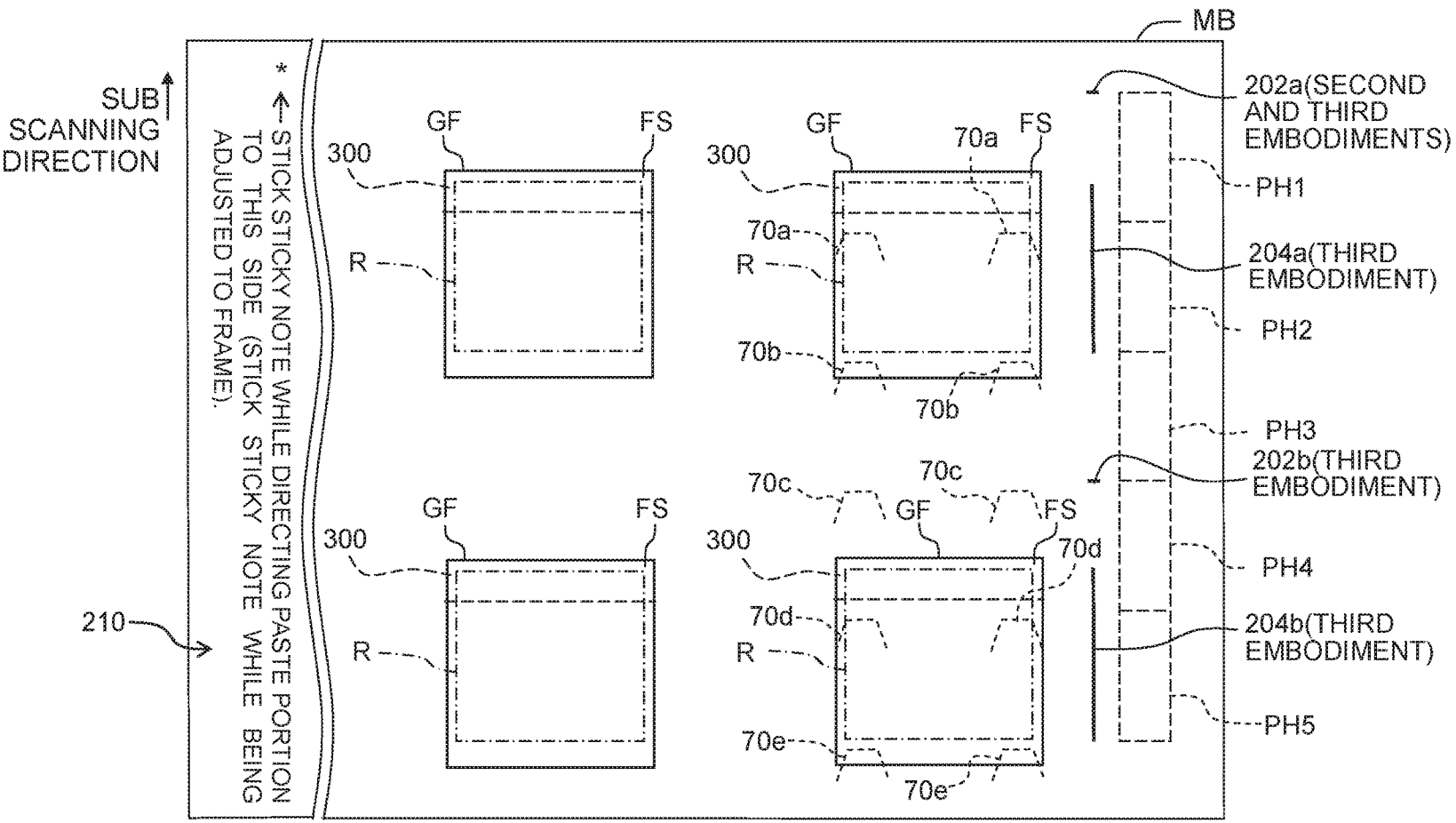
FIG. 7 explains another exemplary mount.

An explanation will now be made about the mount MB with reference to FIGS. 6 and 7. The upward direction as viewed on the paper surfaces of FIGS. 6 and 7 corresponds to the conveyance direction (i.e., the sub scanning direction) provided when the printer PR conveys the mount MB. That is, the left-right direction of the paper surface corresponds to the main scanning direction. FIG. 6 depicts a mount MB to be printed in accordance with the mount data of S16 if the sticky note having the first size is selected in S10 in FIG. 5A. Further, FIG. 7 depicts another mount MB to be printed in accordance with the mount data of S16 if the sticky note having the second size different from the first size is selected in S10 in FIG. 5A.

As depicted in FIG. 6, the mount MB includes a plurality of guide frames GF and a message 210 printed on the sheet S. Note that in FIG. 6, images, which are represented by reference numerals 202*a*, 202*b*, 204*a*, 204*b*, seem to be printed on the mount MB. However, in this embodiment, the images are not printed on the mount MB.

The respective guide frames GF indicate the sticking positions of the sticky notes having the first size. The position and the size of each of the guide frames GF are previously determined in the specified template data. The size of each of the guide frames GF is the same as that of the size of the sticky note (i.e., the first size). A technique for specifying the position of each of the guide frames GF will be explained later on.

The plurality of guide frames GF include the two or more (three in the example depicted in FIG. 6) guide frames GF which are arranged on the downstream side in the sub scanning direction and which are arranged at equal intervals in the left-right direction, and the two or more guide frames GF which are arranged on the upstream side in the sub scanning direction and which are arranged at equal intervals in the left-right direction. In the following description, the former guide frames GF are referred to as "guide frames in the first row", and the latter guide frames GF are referred to as "guide frames in the second row". In the left-right direction, the positions of the respective guide frames in the first row are coincident with the positions of the respective guide frames in the second row. Note that in the following description, not only the guide frames but also the sticky notes or the like are also explained while being referred to with the terms of "first row" and "second row" in some cases.

FIG. 6 depicts a situation in which the sticky notes FS are stuck to the guide frames GF. The message 210 includes a message which is provided to urge the user so that the sticky notes FS are stuck in the guide frames GF in a state in which an adhesion area 300 in the sticky note FS (i.e., the area applied with the paste) is positioned at the upper end portion in the guide frame GF. Therefore, when the mount MB is conveyed in the sub scanning direction in the printer PR, then the adhesion area 300 in the sticky note FS is arranged on the downstream side in the sub scanning direction, and the end portion, which is disposed on the side opposite to the adhesion area 300, is arranged on the upstream side in the sub scanning direction.

Symbols PH1 to PH5, which are depicted by broken lines, indicate the positions of the print head PH when the first to fifth paths are executed in such a situation that the printer PR executes the printing on the sticky notes FS stuck to the mount MB. More correctly, the length in the sub scanning direction of each of PH1 to PH5 indicates the length in which the printing can be performed in one path by utilizing those ranging from the most upstream nozzle N1 to the most downstream nozzle NE. Further, each of symbols 70*a* to 70*e*, which is depicted by broken lines, indicates the position of the lower surface of one corrugated plate 70 (i.e., the holding position) when the print head PH executes the first to fifth paths. Then, each of symbols R, which is depicted by long dashed short dashed lines, indicates the area (hereinafter referred to as "printing area R") in which the image is to be printed in each of the sticky notes FS. The length of the long side and the length of the short side of the printing area R are smaller than the length of the long side and the length of the short side of the sticky note FS respectively. When the print head PH executes the printing on the printing area R, a part or parts of the sticky note FS is/are held or pressed by the corrugated plate 70. For example, when the print head PH executes the first path (see PH1), the plate 70 holds the central portion of the sticky note FS in the first row (see 70*a*). That is, the plate 70 holds the upstream side in the sub scanning direction (i.e., the lower side as viewed in FIG. 6) from the adhesion area 300 in the sticky note FS. Then, the print head PH passes through the downstream side in the sub scanning direction from the holding position of the plate 70 (i.e., the position of 70*a*). Therefore, it is possible to appropriately execute the printing on the concerning portion in such a state that the portion (i.e., the portion disposed between the adhesion area 300 and the symbol 70*a*), through which the print head PH passes in the sticky note FS, is not curled toward the print head PH. Further, when the print head PH executes the second path (see PH2), the corrugated plate 70 holds the end portion on the lower side in the sub scanning direction of the sticky note FS in the first row (see 70*b*). In this way, in this embodiment, when the path is executed in order to perform the printing on the sticky note FS, the corrugated plate 70 holds the part of the sticky note FS. Then, the path for the printing on the sticky note FS is not executed in a state in which the corrugated plate 70 does not hold the sticky note FS. For example, when the print head PH executes the third path (see PH3), the corrugated plate 70 does not hold the sticky note FS in the first row (see 70*c* in the drawing). In this state, the sticky note FS may be curled toward the print head PH. However, any path (i.e., the discharge of the ink toward the sticky note FS) for the printing on the sticky note FS is not executed in the state as described above.

Further, the corrugated plate 70 holds the portion on the upstream side in the sub scanning direction from the adhesion area 300 in the sticky note FS. Accordingly, when the print head PH executes the path, such a situation is prevented from being caused that a part of the sticky note FS (especially the end portion disposed on the side opposite to the adhesion area 300) floats and the sticky note FS is brought in contact with the print head PH. Accordingly, the sticky note FS is prevented from becoming dirty by the ink adhered to the print head PH.

In the case of the mount MB depicted in FIG. 7, the size and the position of the guide frame GF are different from those of the mount MB depicted in FIG. 6. When the mount MB depicted in FIG. 7 is utilized, a part or parts of the sticky note FS is/are also held or pressed by the corrugated plate 70 when the print head PH executes the path, in the same manner as the case in which the mount MB depicted in FIG. 6 is utilized. However, when the mount MB depicted in FIG. 7 is utilized, one sheet of the sticky note FS is simultaneously held by the two corrugated plates 70. Therefore, the print head PH can execute the discharge of the ink toward the sticky note FS in a state in which the sticky note FS is not curled toward the print head PH. Further, such a situation is also prevented from being caused that the sticky note FS is brought in contact with the print head PH.

Figure 5A:
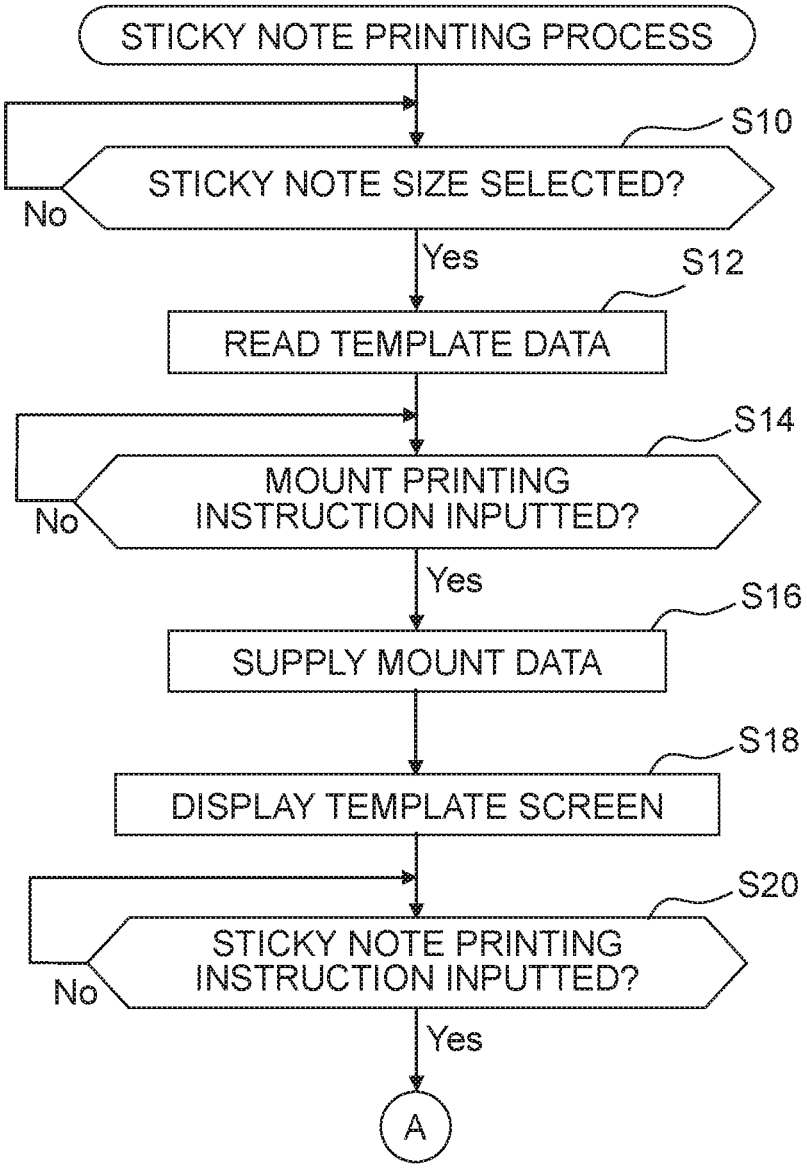
FIGS. 5A and 5B depict a flow chart illustrating a sticky note printing process.

When the process of S16 depicted in FIG. 5A is executed as described above, and the mount MB (see FIGS. 6 and 7) is provided to the user, then the user can stick the respective sticky notes FS at the positions indicated by the respective guide frames GF of the mount MB. Then, the user can set, to the printer PR, the mount MB to which the sticky notes FS have been stuck.

Figure 8:
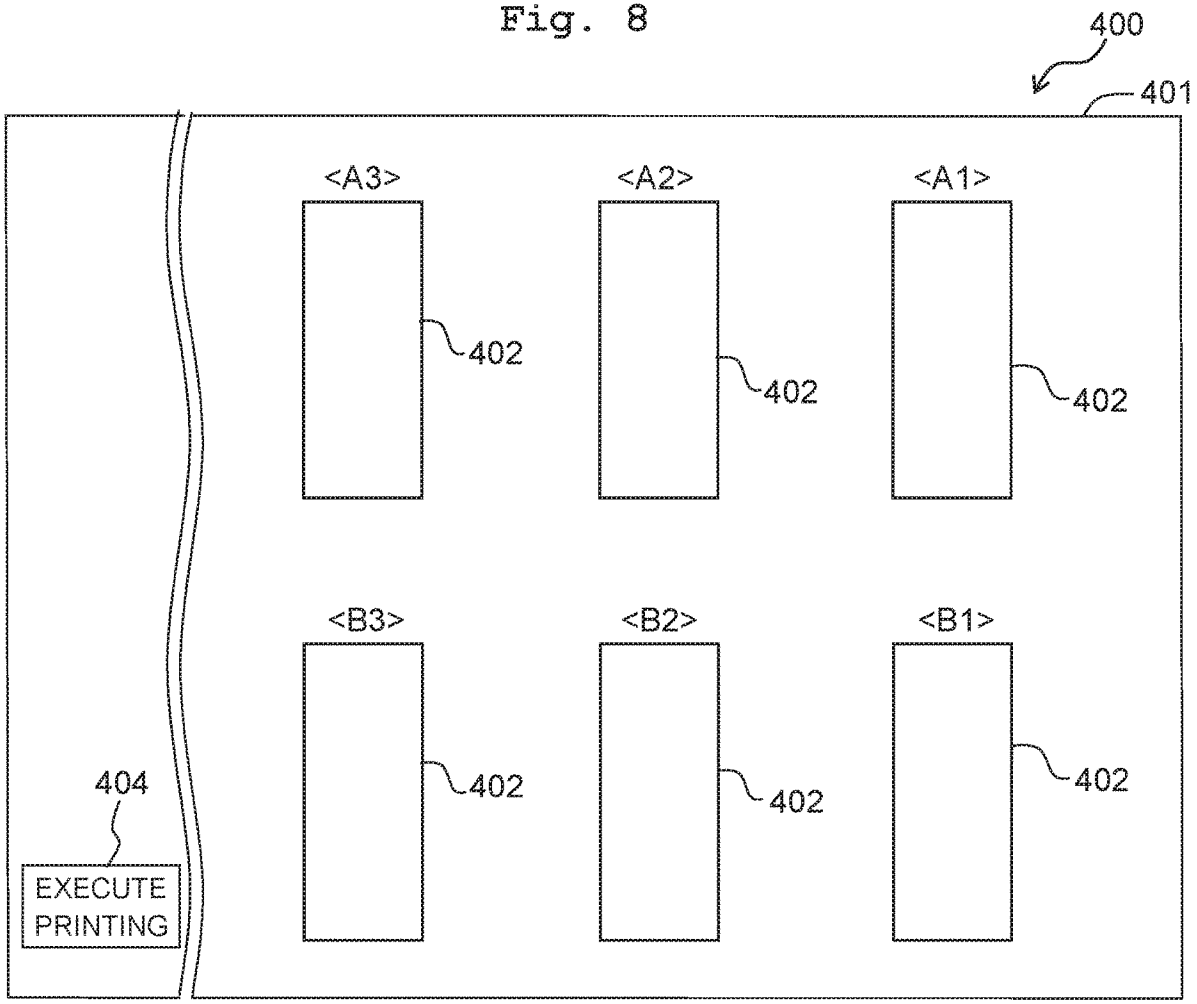
FIG. 8 depicts an exemplary template screen.

In S18 depicted in FIG. 5A, CPU 122 allows the display 106 to display the template screen corresponding to the specified template data. As depicted in FIG. 8, the template screen 400 includes a frame image 401 which corresponds to the frame of the mount MB, a plurality of input areas 402, and a printing execution button 404. Each of the input areas 402 is the area which is provided to input an object image to be printed on the sticky note FS. The aspect ratio of the frame image 401 is coincident with the aspect ratio of the mount MB printed in S16. The positional relationship between the frame image 401 and the respective input areas 402 is equal to the positional relationship between the mount MB and the respective guide frames GF. The user can input the object image (for example, a desired character string) into the input area 402 by operating the operation device 104. In this case, the user can either input an identical object image into the respective input areas 402, or the user can input different object images thereinto. The object image may be a character string, a photograph or the like, or a combination thereof. Note that the user can also designate the direction of the object image. When the respective object images are inputted into the respective input areas 402, CPU 122 can acquire the respective pieces of the object image data to represent the respective object images.

In S20, CPU 122 stands by for the input of the sticky note printing instruction. The user sets, to the printer PR, the mount MB to which at least one sheet of the sticky note FS is stuck, and the user selects the printing execution button 404 in the template screen 400. In this procedure, CPU 122 determines that the sticky note printing instruction is inputted (S20: YES), and CPU 122 executes S22.

In S22, CPU 122 generates the printing data 500. At first, CPU 122 generates the solid image data which represents the white solid image corresponding to the white sheet having the same size as that of the mount MB. The solid image data is combined with the respective pieces of the object image data acquired in S20 to generate the combined data (composite or synthesized data). In this case, in the printer driver 126, it is previously determined that the object image data should be combined at what position in the solid image data depending on the size of the sticky note selected in S10. Specifically, the position in the solid image data, at which the object image data should be combined, is determined so that the positional relationship of the respective object images in the solid image is coincident with the positional relationship of the respective printing areas R in the mount MB. The combined data includes a plurality of pieces of pixel data, and each of the pieces of pixel data represents the multi-gradation (for example, 256-gradation) RGB value.

Subsequently, CPU 122 executes the color conversion (color transformation) process for the combined data to generate the CMYK image data. The CMYK image data includes a plurality of pieces of pixel data (i.e., the pieces of pixel data of the same number as that of the pieces of printing image data described above), and each of the pieces of pixel data represents the multi-gradation (for example, 256-gradation) CMYK value.

Subsequently, CPU 122 executes the half tone process (for example, the process of the error diffusion method, the dither method and the like) for the CMYK image data described above to generate the binary data. The binary data includes a plurality of pieces of pixel data (i.e., the pieces of pixel data of the same number as that of the pieces of CMYK image data described above), and each of the pieces of pixel data includes the two-gradation (i.e., "1" or "0") CMYK value. The pixel data "1" represents Dot ON (i.e., discharge of the ink), and the pixel data "0" represents Dot OFF (i.e., no discharge of the ink). In this embodiment, the nozzles N1 to NE (see FIG. 2), which are formed on the print head PH, form the dots by discharging the black (K) ink droplets. Therefore, each of the pieces of pixel data included in the binary data is constructed by K="1" or K="0". However, when the nozzle groups other than the nozzles N1 to NE, which correspond, for example, to CMY, are also provided, the respective pixels in the binary data include not only the value corresponding to K but also the values corresponding to CMY. Further, in this embodiment, the two-gradation data, which represents "1" or "0", is generated. However, in a modified embodiment, it is also allowable to generate data of three-gradation or more. For example, it is also allowable to generate four-gradation data of "large dot ON, middle dot ON, small dot ON, and dot OFF".

Subsequently, CPU 122 generates the printing data 500 on the basis of the binary data described above. The printing data 500 includes a plurality of pieces of path data. One piece of path data corresponds to one path (i.e., one round of the main scanning operation). In each of the pieces of path data, the nozzle is allowed to correspond to each of the pieces of pixel data included in the binary data in relation to each of the plurality of nozzles N1 to NE. For example, in the case of the path data of the first path illustrated in S22, the pieces of pixel data, which are allowed to correspond to the nozzle N1, represent, for example, "1", "0", "0" or the like in an order as started from the left. This means the fact that the discharge, no discharge, and no discharge of the ink droplets from the nozzle N1 are successively executed during the process of the first path. Each of the pieces of path data further includes the conveyance amount data which represents the conveyance amount of the mount MB in the sub scanning direction. For example, the path data of the first path includes the conveyance amount data which represents the conveyance amount PL. This means the fact that the mount MB is conveyed by the conveyance amount PL in the sub scanning direction before the first path is executed.

In this embodiment, the printer PR executes the so-called one-path printing. The one-path printing is such a printing technique that another dot is not formed between two dots which adjoin in the sub scanning direction of a plurality of dots after the plurality of dots for constructing the object image are formed on the sticky note FS by executing one round of path by the print head PH, and another dot is not formed between two dots which adjoin in the main scanning direction of the plurality of dots. The conveyance amount PL for realizing the one-path printing is N nozzle pitches. In this case, "N" is the total number of the nozzles for discharging one color (for example, K) ink. Further, the nozzle pitch is the distance between the two nozzles which adjoin in the sub scanning direction in the print head PH.

In S24, CPU 122 supplies the printing data 500 generated in S22 to the printer PR. Accordingly, the controller 20 of the printer PR controls the sheet conveyance device TU and the head driving device AU in accordance with the printing data 500. Specifically, the controller 20 firstly allows the sheet conveyance device TU to convey the mount MB set to the printer PR to a predetermined printing start position. Then, the controller 20 successively utilizes the path data included in the printing data 500 so that the controller 20 allows the sheet conveyance device TU to execute the conveyance of the mount MB in accordance with the conveyance amount data and the controller 20 allows the head driving device AU to execute the path of the print head PH in accordance with the respective pieces of the pixel data. Accordingly, the printing image, in which the object image is arranged in the printing area R in the mount MB, is printed on the mount MB. That is, the object image is printed on the sticky note FS.

As described above, when the printer PR is allowed to execute the printing by using the mount MB, if the print head PH executes the path with respect to the printing area R of the sticky note FS, then the part of the sticky note FS is held or pressed by the corrugated plate 70 (see FIG. 6). Accordingly, it is possible to execute the discharge of the ink toward the sticky note FS in the state in which the sticky note FS is not curled toward the print head PH. Further, when the print head PH executes the path, such a situation is also prevented from being caused that a part of the sticky note FS floats and the sticky note FS is brought in contact with the print head PH. The corrugated plate 70, which is provided to prevent the both end portions of the sheet S in the sub scanning direction from being curled, can be utilized as the holding member for the sticky note FS. Therefore, it is unnecessary to provide any exclusively usable holding member for holding the sticky note FS. Therefore, even when the printer PR is not provided with any exclusively usable construction for performing the printing on the sticky note, it is possible to appropriately realize the printing on the sticky note FS.

Further, in this embodiment, the mount MB is constructed such that a plurality of sticky notes FS can be aligned and stuck in the main scanning direction and the sub scanning direction respectively. Therefore, it is possible to appropriately execute the printing of the object image on the plurality of sticky notes FS stuck to one sheet of the mount MB respectively.

<Method for Determining Sticky Note Sticking Area (Position of Guide Frame GF)>

As described above, in this embodiment, the position of each of the guide frames GF on the mount MB (i.e., the sticky note sticking area) is previously determined for each of the pieces of template data. Then, each of the pieces of template data is previously generated by a vendor. An explanation will be made below about a method for determining the sticky note sticking area by the vendor.

An explanation will be made with reference to FIG. 9 about a method for determining the sticky note sticking areas in the first row. At first, the vendor establishes the starting point SA1 at the position which is separated by a distance corresponding to a predetermined blank space on the upstream side from the downstream end in the sub scanning direction (upward-downward direction as viewed in FIG. 9) of the mount MB. Subsequently, vendor determines the minimum value of n at which Expression (1) shown below holds.

$$FL \leq PL*n+UM \qquad \text{Expression (1)}$$

In Expression (1), FL represents the length of the sticky note FS in the sub scanning direction (i.e., the length of the long side of the rectangular sticky note FS). PL represents the conveyance amount for every one path, which is N nozzle pitches in this embodiment. UM represents the holding length of the sticky note FS brought about by the corrugated plate 70, which is a previously determined length. n corresponds to the number of paths (i.e., the number of times of the main scanning operation) required for the printing on the sticky note FS in the first row.

If the minimum value of n, at which Expression (1) holds, is determined, the vendor calculates the value of "PL*n+UM" as the right side of Expression (1). Then, the vendor specifies the position separated on the upstream side in the sub scanning direction by the calculated value from the starting point SA1 described above, as the upstream end A1 of the sticky note sticking area in the first row. Further, the length in the sub scanning direction of each of the sticky note sticking areas is coincident with the length (i.e., FL) in the sub scanning direction of the sticky note FS.

For example, a specified example is assumed, in which FL is 75 mm, PL is 35 mm, and UM is 10 mm. In this case, the minimum value of n, at which Expression (1) holds, is 2, and the value of the right side of Expression (1) is 80 (mm). The vendor determines the position separated on the upstream side by 80 mm from the starting point SA1, as the upstream end A1 of the sticky note sticking area in the first row, in relation to the sub scanning direction.

Subsequently, the vendor determines the position in the main scanning direction (left-right direction as viewed in FIG. 9) of each of the sticky note sticking areas in the first row on the basis of the interval between the respective corrugated plates 70 in the main scanning direction and the length in the main scanning direction of the sticky note FS (i.e., the length of the short side of the rectangular sticky note FS). That is, the positions in the main scanning direction of the respective sticky note sticking areas are determined so that the respective corrugated plates 70 hold the central portions of the respective sticky notes FS in the main scanning direction. Further, the length in the main scanning direction of each of the sticky note sticking areas is coincident with the length in the main scanning direction of the sticky note FS (i.e., the length of the short side of the rectangular sticky note FS). In this procedure, if the length in the main scanning direction of the sticky note FS is longer than the interval between the two adjoining corrugated plates 70 (see FIG. 7), the vendor determines the position in the main scanning direction of each of the sticky note sticking areas so that the respective two adjoining corrugated plates 70 hold the portions separated by an identical distance from the central portion of each of the sticky notes FS in relation to the main scanning direction.

The vendor further determines the printing area R in which the object image is to be arranged, in relation to each of the sticky note sticking areas. Specifically, the vendor firstly calculates "FL−UM" (for example, 75−10=65 mm in the example described above) to determine the length in the sub scanning direction of the arrangement area D in which the printing area R can be arranged. The length in the main scanning direction of the arrangement area D is coincident with the length in the main scanning direction of the sticky note FS (i.e., the length of the short side of the rectangular sticky note FS). Then, the vendor determines the arrangement area D as indicated by the hatching so that the downstream end of the sticky note sticking area is coincident with the downstream end of the arrangement area D in relation to the sub scanning direction, and the both ends of the sticky note sticking area are coincident with the both ends of the arrangement area D in relation to the main scanning direction.

Subsequently, the vendor determines the printing area R which is one size smaller than the arrangement area D, at the inside of the arrangement area D. That is, the positions of the both ends of the printing area R are the positions which are disposed inwardly by predetermined values t1 from the both ends of the arrangement area D, in relation to the main scanning direction. Further, the positions of the both ends of the printing area R are the positions which are disposed inwardly by predetermined values t2 from the both ends of the arrangement area D, in relation to the sub scanning direction.

Next, an explanation will be made with reference to FIG. 10 about a method for determining the sticky note sticking area in the second row. At first, the vendor determines the minimum value of m at which Expression (2-1) shown below holds.

$$PL*n+UM+(FL+SL)\leq PL*m+UM \quad \text{Expression (2-1)}$$

In Expression (2-1), FL, PL, UM, and n are the same as or equivalent to those of FIG. 9. m corresponds to the total number of paths required to complete the printing on both of the sticky note FS in the first row and the sticky note FS in the second row. SL corresponds to the minimum space in the sub scanning direction between the sticky note FS in the first row and the sticky note FS in the second row, which is the value calculated in accordance with Expression (2-2) shown below.

$$SL=PL*(n+1)-(PL*n+UM) \quad \text{Expression (2-2)}$$

As depicted in FIG. 11A, it is necessary that SL is not less than the margin SM of the carriage 60 to which the print head PH is attached, for the following reason. That is, if SL is smaller than SM, as depicted in a comparative example in FIG. 11B, there is a possibility that the end portion of the sticky note FS in the first row may float during the execution of the printing on the sticky note FS in the second row, and the floating end portion may be brought in contact with the carriage 60. Therefore, if SL, which is calculated in accordance with Expression (2-2), is smaller than SM, the vendor utilizes, as SL, the value which is coincident with SM to calculate the minimum value of m at which Expression (2-1) holds.

When the vendor calculates the value of m, the vender calculates the value of "PL*m+UM" which is the right side of Expression (2-1). Then, the vendor specifies the position which is separated on the upstream side by the calculated value from the starting point SA1 described above, as the upstream end A2 in the sub scanning direction of the sticky note sticking area in the second row, in relation to the sub scanning direction.

For example, in the specified example described above, FL is 75 mm, PL is 35 mm, UM is 10 mm, and n is 2. Further, SM is 5 mm. In this case, the value of SL described above is 25 (mm). Then, the minimum value of m, at which Expression (2-1) described above holds, is 5. The value of "PL*m+UM" which is the right side of Expression (2-1) is 185 (mm). The vendor specifies the position separated by 185 mm on the upstream side from the starting point SA1, as the upstream end A2 in the sub scanning direction of the sticky note sticking area in the second row.

The position in the main scanning direction of the sticky note sticking area in the second row is the same as the position in the main scanning direction of the sticky note sticking area in the first row. Further, the vendor determines the printing area R of the sticky note sticking area in the second row in the same manner as the sticky note sticking area in the first row.

The vendor can determine the sticky note sticking area in the third row and the followings in accordance with a method which is the same as or equivalent to the method for determining the sticky note sticking area in the second row. However, whether or not the sticky note sticking area in the third row and the followings should be determined is determined depending on the size of the sticky note and the size of the mount. For example, if there is no space for arranging the sticky note FS in the third row and the followings as in the examples of the mount MB depicted in FIGS. 6 and 7, the vendor does not determine the sticky note sticking area in the third row and the followings.

If the vendor determines the respective sticky note sticking areas in accordance with the method as described above, the vendor can generate the mount data which represents the respective guide frames GF for indicating the respective sticky note sticking areas and the image of the message 210 (see FIGS. 6 and 7). The vendor can generate the mount data in the same manner as described above for the sizes of various sticky notes. As a result, the template data group 128, which includes a plurality of pieces of mount data, is generated. The mount MB is printed by utilizing the template data group 128 as described above (S16 depicted in FIG. 5A). Further, the vendor prepares the printer driver 126 so that the printing data, which represents the printing image including the object images arranged in the printing area R determined as described above, is generated (S22 depicted in FIG. 5B). As a result, the printer PR can be appropriately allowed to execute the printing on the sticky note FS in such a state that the corrugated plate 70 holds the part of the sticky note FS stuck to the mount MB.

<Correlation>

The print engine PE, the controller 120, and the printer driver 126 are examples of the "print execution device", the "controller", and the "computer program" respectively. The corrugated plate 70 is an example of the "holding member". The plurality of sticky notes FS in the first row stuck to the mount MB are examples of the "first sticky note" and the "second sticky note". Then, the respective printing areas R of the plurality of sticky notes FS in the first row are examples of the "first predetermined area" and the "second predetermined area". The template screen 400 is an example of the "mount image".

[Second Embodiment]

In a second embodiment, the printer PR is provided with a so-called leading portion skip function. The leading portion skip function is such a function that the printer PR conveys the sheet S up to the position at which any object image other than a blank space is arranged (i.e., the printer PR skips the leading space portion) if the blank space is present at a downstream end portion in the sub scanning direction of the printing image, and the printer PR starts the main scanning operation of the print head PH from the position at which the object image is arranged.

Also in this embodiment, the vendor determines the respective sticky note sticking areas in accordance with a method which is the same as or equivalent to that of the first embodiment (see FIGS. 9 and 10). However, the vendor prepares the printer driver 126 so that the path leading data, which represents the path leading image 202*a* (see FIGS. 6 and 7), is combined at the position of the starting point SA1 depicted in FIG. 9, when the combined data (i.e., the combined data in which the object image data is combined with the solid image data) is generated in S22 depicted in FIG. 5B. Therefore, when the printing is executed in accordance with the printing data 500 generated in S22, the path leading image 202*a* is printed on the mount MB as depicted in FIGS. 6 and 7. In this procedure, in the case of the printing image represented by the printing data 500, the first direction (i.e., the upward-downward direction as depicted in FIGS. 6 and 7) corresponding to the sub scanning direction and the second direction (i.e., the left-right direction) corresponding to the main scanning direction are determined. Then, the first side (i.e., the lower side) corresponding to the upstream side in the sub scanning direction and the second side (i.e., the upper side) corresponding to the downstream side in the sub scanning direction are determined in the first direction. Then, the path leading image 202*a* is arranged on the second side (i.e., the upper side) as compared with the end portion on the second side of the object image (i.e., the end portion on the second side of the printing area R) in the first direction. More specifically, the path leading image 202*a* is arranged at the position subjected to the printing by the most downstream nozzle NE when the main scanning operation of the first path is performed in accordance with the printing data 500. That is, at least one piece of the respective pieces of the image data allowed to correspond to the nozzle NE indicates "1" in the path data of the first path included in the printing data 500.

In the technique depicted in FIGS. 9 and 10, the starting point SA1 is determined while considering the predetermined blank space. However, if the leading portion skip function is executed, the first path is not executed from the position corresponding to the starting point SAL In this case, even when the sticky note FS is stuck to the already determined sticky note sticking area, the path may be executed in order to perform the printing on the sticky note FS in a state in which the sticky note FS is not held or pressed by the corrugated plate 70. In order to avoid this situation, as described above, in this embodiment, CPU 122 generates the printing data 500 which represents the printing image including the path leading image 202*a* (S22 depicted in FIG. 5B). The path leading image 202*a* is included in the printing image. Therefore, the printer PR prints the path leading image 202*a* by means of the nozzle NE. On this account, it is possible to avoid the execution of the conveyance of the mount MB in accordance with the leading portion skip function in the printer PR. As a result, the path for performing the printing on the sticky note FS is appropriately executed in a state in which the sticky note FS is held by the corrugated plate 70.

[Third Embodiment]

In a third embodiment, the printer PR is provided with the leading portion skip function, and the printer PR is provided with a so-called intermediate portion skip function. The intermediate portion skip function is such a function that the printer PR conveys the sheet S up to the position at which any object image other than a blank space is arranged (i.e., the printer PR skips the intermediate space portion) if the blank space is present at an intermediate portion in the sub scanning direction of the printing image, and the printer PR starts the main scanning operation of the print head PH from the position at which the object image is arranged.

Also in this embodiment, the vendor determines the respective sticky note sticking areas in the first row in accordance with a method which is the same as or equivalent to that of the first embodiment. However, in this embodiment, as depicted in FIG. 12, the vendor determines the sticky note sticking area in the second row in accordance with a method which is different from that of the first embodiment. At first, the vendor establishes a new starting point SB2 at an arbitrary position which is separated by not less than SM (see FIG. 11A) from the upstream end A1 of the sticky note sticking area in the first row. Then, the vendor determines the position of the upstream end B2 of the sticky note sticking area in the second row on the basis of the new starting point SB2 in accordance with a method which is the same as or equivalent to that of the method for determining the upstream end A1 of the sticky note sticking area in the first row (see FIG. 9). The position in the main scanning direction of the sticky note sticking area in the second row is the same as the position in the main scanning direction of the sticky note sticking area in the first row. Further, the vendor determines the printing area R of the sticky note sticking area in the second row in the same manner as the case of the sticky note sticking area in the first row.

Figure 5B:
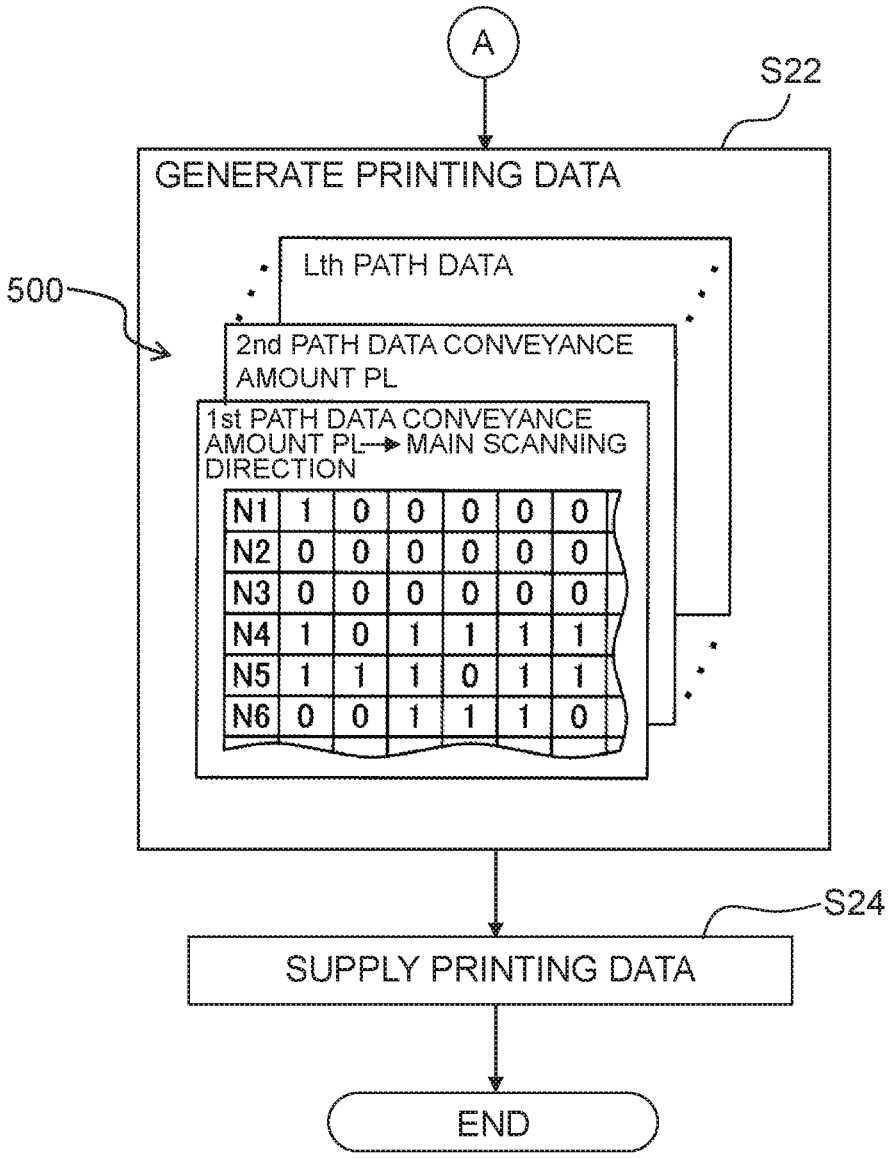

In this embodiment, when the combined data (i.e., the combined data in which the object image data is combined with the solid image data) is generated in S22 depicted in FIG. 5B, the vendor prepares the printer driver 126 so that the path leading data, which represents the path leading image 202*a* (see FIGS. 6 and 7), is combined at the position of the starting point SA1 depicted in FIG. 9, and the skip prevention data, which represents the skip prevention image 204*a* (see FIGS. 6 and 7) having the length corresponding to the printing area R depicted in FIG. 9, is combined. In addition thereto, when the combined data is generated, the vendor further prepares the printer driver 126 so that the path leading data, which represents the path leading image 202*b* (see FIGS. 6 and 7), is combined at the position of the starting point SB2 depicted in FIG. 12, and the skip prevention data, which represents the skip prevention image 204*b* (see FIGS. 6 and 7) having the length corresponding to the printing area R in the second row, is combined.

Therefore, when the printing is executed in accordance with the printing data 500 generated in S22, the path leading images 202*a*, 202*b* and the skip prevention images 204*a*, 204*b* are printed on the mount MB as depicted in FIGS. 6 and 7.

Also in this embodiment, the path leading image 202*a* is arranged on the second side (i.e., the upper side) as compared with the end portion on the second side (i.e., the upper side) of the object image in the first row (i.e., the end portion on the second side of the printing area R), in relation to the first direction (i.e., the upward-downward direction as depicted in FIGS. 6 and 7), of the printing image, corresponding to the sub scanning direction. More specifically, the path leading image 202*a* is arranged at the position at which the printing is performed by the most downstream nozzle NE when the main scanning operation of the first path is performed in accordance with the printing data 500. Then, the skip prevention image 204*a* is arranged at the position which is different from the printing area R in the first row in the second direction (i.e., the left-right direction), and the skip prevention image 204*a* extends continuously over the entire region between the end portion on the first side (i.e., the lower side) and the end portion on the second side (i.e., the upper side) of the printing area R in the first direction (i.e., the upward-downward direction). The path leading image 202*b* is arranged on the second side (i.e., the upper side) as compared with the end portion on the second side (i.e., the upper side) of the object image in the second row (i.e., the end portion on the second side of the printing area R) in the first direction. The skip prevention image 204*b* is arranged at the position which is different from the printing area R in the second row in the second direction (i.e., the left-right direction), and the skip prevention image 204*b* extends continuously over the entire region between the end portion on the first side (i.e., the lower side) and the end portion on the second side (i.e., the upper side) of the printing area R in the first direction (i.e., the upward-downward direction).

In the example depicted in FIGS. 9 and 12, the printing on the sticky note FS in the first row is executed by means of the two paths (i.e., the first path and the second path). Then, the printing on the sticky note FS in the second row is also executed by means of the two paths (i.e., the third path and the fourth path). In this embodiment, the path data of the third path includes the conveyance amount data which represents the conveyance amount corresponding to the distance between the starting point SB2 and the downstream end A1 depicted in FIG. 12 (i.e., arbitrary conveyance amount of not less than SM, which may be N nozzle pitches)

in place of the conveyance amount data which represents the conveyance amount PL (i.e., N nozzle pitches). In this embodiment, when the main scanning operation of the first path is performed, the path leading image 202*a* is printed on the mount MB by the most downstream nozzle NE. Further, when the main scanning operations of the first path and the second path are executed, the skip prevention image 204*a* is printed on the mount MB. Then, when the main scanning operation of the third path is performed, the path leading image 202*b* is printed on the mount MB by the most downstream nozzle NE. Further, when the main scanning operations of the third path and the fourth path are executed, the skip prevention image 204*b* is printed on the mount MB.

When the printer PR of this embodiment is used, if at least one of the leading portion skip function and the intermediate portion skip function is executed, then the path for performing the printing on the sticky note FS may be also executed in a state in which the sticky note FS is not held by the corrugated plate 70. On the contrary, as described above, in this embodiment, CPU 122 generates the printing data 500 which represents the printing image including the path leading images 202*a*, 202*b* and the skip prevention images 204*a*, 204*b* (S22 depicted in FIG. 5B). The path leading images 202*a*, 202*b* and the skip prevention images 204*a*, 204*b* are included in the printing image. Therefore, the printer PR prints the path leading images 202*a*, 202*b* and the skip prevention images 204*a*, 204*b* on the mount MB along with the printing of the object image. On this account, it is possible to prevent the conveyance of the mount MB in accordance with the leading portion skip function and the intermediate portion skip function in the printer PR. As a result, the path for performing the printing on the sticky note FS is appropriately executed in a state in which the sticky note FS is held by the corrugated plate 70.

[Fourth Embodiment]

Figure 13:
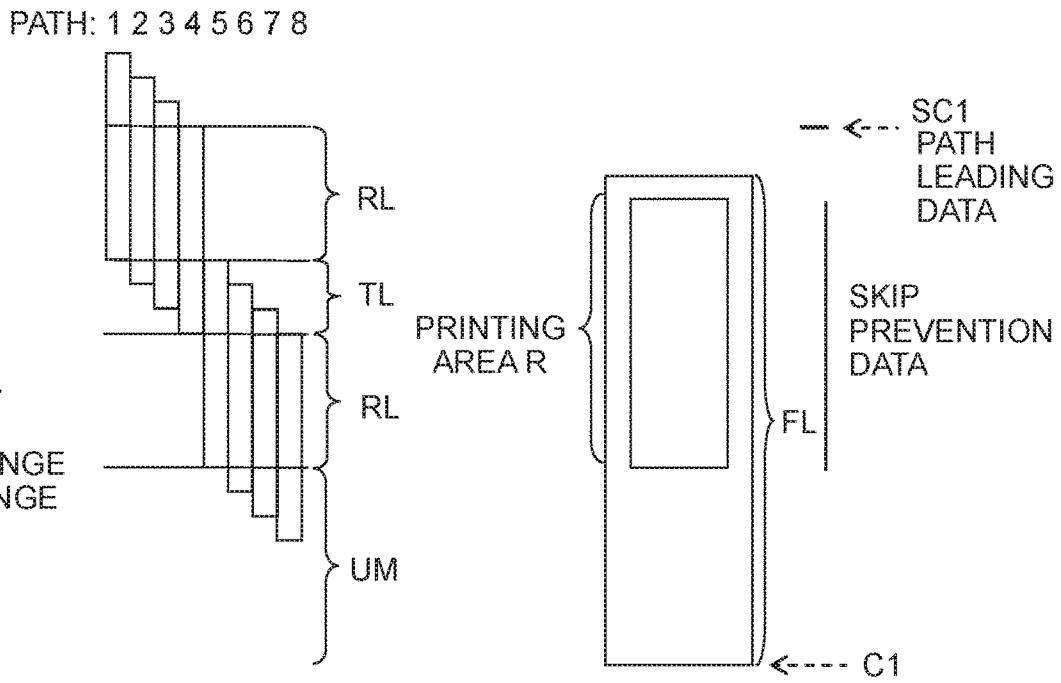
FIG. 13 explains a method for determining a sticky note sticking area in a first row in a fourth embodiment.

In a fourth embodiment, the printer PR executes the so-called interlace printing. The interlace printing resides in such a printing technique that a plurality of dots, which constitute the object image, are formed on the sticky note FS by allowing the print head PH to execute the main scanning operation, and then one or more dots are formed between the two dots which adjoin in the sub scanning direction and which are included in the plurality of dots. In other words, the interlace printing resides in such a printing technique that the main scanning operation (i.e., the path) is executed a plurality of times in order to form a plurality of dots during one nozzle pitch provided in the sub scanning direction. In this embodiment, as depicted in FIG. 13, any one of the respective portions of the object image arranged in the printing area R is printed by four times of the main scanning operation. That is, the four-path interlace printing is executed.

An explanation will be made about the process to be performed in order that the vendor generates the template data in this embodiment. At first, the vendor determines the sticky note sticking area in the first row on the mount MB. An explanation will be made with reference to FIG. 13 about a method for determining the sticky note sticking area in the first row. At first, the vendor establishes the starting point SC1 at the position which is separated by the distance corresponding to a predetermined blank space on the upstream side from the downstream end in the sub scanning direction (upward-downward direction as viewed in FIG. 13) of the mount MB.

Then, the vendor determines the value of i at which the following expression (4) holds.

$$FL \leq RL*i+TL*(i-1)+UM \qquad \text{Expression (4)}$$

In Expression (4) described above, FL and UM are as described above. As depicted in FIG. 13, RL corresponds to the length in the sub scanning direction of the portion (hereinafter referred to as "large overlap range") at which the overlap range of each of the paths is large. Then, TL corresponds to the length in the sub scanning direction of the portion (hereinafter referred to as "small overlap range") at which the overlap range of each of the paths is small. i corresponds to the number of large overlap ranges provided to execute the printing on the sticky note FS.

The vendor specifies the value of i at which Expression (4) holds, and the vendor calculates the value of "RL*i+TL*(i−1)+UM" which is the right side of Expression (4). The vendor determines the position which is separated in the sub scanning direction by the calculated value from the starting point SC1 described above, as the upstream end C1 of the sticky note sticking area in the first row. Note that the method for determining the position in the main scanning direction of the sticky note sticking area in the first row is the same as or equivalent to that depicted in FIG. 9. Further, the method for determining the printing area R of each of the sticky note sticking areas is also the same as or equivalent to that depicted in FIG. 9. Subsequently, the vendor determines the sticky note sticking areas in the second row and the followings on the mount MB. The sticky note sticking areas in the second row and the followings are determined in accordance with a method which is substantially the same as or equivalent to that used for the first row.

If the vendor determines the respective sticky note sticking areas in accordance with the technique described above, the vendor can generate the mount data which represents the mount image including the guide frames GF for representing the respective sticky note sticking areas and the image of the message 210 (see FIGS. 6 and 7). The vendor can generate the mount data in the same manner as described above for the sticky notes of various sizes. As a result, the template data group 128, which includes a plurality of pieces of mount data, is generated.

In this embodiment, a part of the content of the sticky note printing process (see FIGS. 5A and 5B) executed by CPU 122 of the terminal device TR is also different from that of the first embodiment. In S22 depicted in FIG. 5B, CPU 122 generates the printing data 500. As depicted in FIG. 13, when the four-path interlace printing is executed, then the mount MB is conveyed by a small conveyance amount (specifically ¼ nozzle pitch) before the execution of the first to fourth paths, and the mount MB is conveyed by a large conveyance amount (specifically (N−1)+¼ nozzle pitch) before the execution of the fifth path. Therefore, the conveyance amount data corresponding to the small conveyance amount described above is included in the path data for the first to fourth paths, and the conveyance amount data corresponding to the large conveyance amount described above is included in the path data for the fifth path.

Note that also in this embodiment, the printer PR may be provided with the leading portion skip function. In this case, the vendor may prepare the printer driver 126 so that the path leading data, which represents the path leading image 202*a* (see FIGS. 6 and 7), is combined at the position of the starting point SC1 depicted in FIG. 13, when the combined data (i.e., the combined data including the solid image data combined with the object image data) is generated in S22 depicted in FIG. 5B.

The printer PR may further include the intermediate portion skip function. In this case, the vendor may prepare the printer driver 126 so that the path leading data, which represents the path leading image 202*a* (see FIGS. 6 and 7), is combined at the position of the starting point SC1 depicted in FIG. 13, and the skip prevention data, which represents the skip prevention image 204*a* (see FIGS. 6 and 7) having the length corresponding to the printing area R depicted in FIG. 13, is combined, when the combined data (i.e., the combined data including the solid image data combined with the object image data) is generated in S22 depicted in FIG. 5B.

The specified embodiments of the present teaching have been explained above in detail. However, they are merely exemplified by way of example, and they do not limit claims. The technique defined in claims includes those obtained by variously deforming or changing the specified embodiments exemplified above by way of example. Modified embodiments of the embodiments described above will be recited below.

[First Modified Embodiment]

The printer PR may execute any multi-path interlace printing other than the four-path interlace printing, including, for example, the two-path interlace printing, without being limited to the one-path printing (first to third embodiments) and the four-path interlace printing (fourth embodiment). Further, the printer PR may execute the so-called "four-path singling printing". The four-path singling printing resides in such a printing technique that a plurality of dots for constructing the object image are formed on the sticky note FS by allowing the print head to execute the kth (k is an integer of not less than 1) main scanning operation, and then three dots are formed between the two dots which are included in the plurality of dots and which adjoin in the main scanning direction. Further, the printer PR may execute any other multi-path singling printing including, for example, the two-path singling printing. Further, the printer may execute the printing in which the multi-path interlace printing and the multi-path singling printing are combined. In this case, the techniques for forming the dots in the respective paths in the multi-path interlace printing and the multi-path singling printing disclosed in the foregoing respective embodiments and this modified embodiment are merely examples. Any arbitrary technique for forming dots may be adopted in respective paths in the multi-path interlace printing and the multi-path singling printing. Even when the printer PR is any one of those referred to in this modified embodiment, the print system disclosed in this specification may execute the printing on the sticky note in accordance with any technique which is the same as or equivalent to the techniques explained in the respective embodiments described above.

[Second Modified Embodiment]

It is also allowable that the memory 124 of the terminal device TR does not store the template data group 128. In this case, in the sticky note printing process (see FIGS. 5A and 5B), CPU 122 may determine the sticky note sticking area and CPU 122 may generate the template data corresponding to the already determined sticky note sticking area in accordance with the techniques explained in the respective embodiments described above (see FIGS. 9 to 13) on the basis of the size of the sticky note selected by the user.

[Third Modified Embodiment]

The memory included in the controller 20 of the printer PR may store the printer driver 126 and the template data group 128. In this case, the controller 20 may execute a process which is the same as or equivalent to the sticky note printing process depicted in FIGS. 5A and 5B in accordance with the printer driver 126 and the template data group 128. In this modified embodiment, the controller 20 of the printer PR is an example of the "controller".

[Fourth Modified Embodiment]

It is also allowable that the printer PR is not provided with the corrugated plate 70. The printer PR may be constructed so that a part of the sticky note FS is held or pressed by the paper feed roller pair 40 when the print head PH executes the main scanning operation in order to perform the printing on the sticky note FS. In this modified embodiment, the paper feed roller pair 40 is an example of the "holding member".

[Fifth Modified Embodiment]

A plurality of types of the mounts corresponding to the sizes of the sticky notes may be previously prepared by the vendor, and the mounts may be shipped while being packaged together with the printer PR. In this case, CPU 122 may omit the processes of S14 and S16 in the sticky note printing process (FIG. 5A). The user may select the mount corresponding to the size of the sticky note desired to be subjected to the printing by the user, from the plurality of types of the mounts shipped together with the printer PR, and the user may set the mount to the printer PR after sticking the sticky note on the mount. Further, the mount MB, which is printed by the printer PR and which has been used once in order to perform the printing on the sticky note, may be reused.

[Sixth Modified Embodiment]

The sticky note FS is not limited to those made of paper. It is also allowable to use a sticky note made of any arbitrary material such as those made of resin. Further, the mount MB is not limited to those made of paper. It is also allowable that the mount MB may be any sheet member such as those made of resin.

[Seventh Modified Embodiment]

In the third embodiment described above, it is also allowable that the skip prevention image 204*a* does not extend continuously over the range corresponding to the entire region between the end portion on the first side (i.e., the lower side) of the printing area R and the end portion on the second side (i.e., the upper side). Specifically, in the example depicted in FIGS. 6 and 7, it is appropriate that the skip prevention image 204*a* is arranged at the position at which the printing is performed by the nozzle NE disposed at the downstream end in the sub scanning direction of the print head (i.e., PH2 depicted in FIGS. 6 and 7) at least when the main scanning operation of the second path is executed. Even in the case of this modified embodiment, it is possible to avoid the execution of the intermediate skip operation.

[Eighth Modified Embodiment]

The sizes of the respective guide frames GF depicted in FIGS. 6 and 7 are not limited to the same sizes as the sizes of the sticky notes FS to be stuck. For example, the size of each of the guide frames GF may be smaller or larger than the size of the sticky note FS to be stuck, provided that the sticky note sticking position can be indicated.

[Ninth Modified Embodiment]

In the respective embodiments described above, the processes depicted in FIGS. 5A and 5B are realized by executing the printer driver 126 (i.e., the software) by CPU 122. In place thereof, at least a part or parts of the processes depicted in FIGS. 5A and 5B may be realized by any hardware such as a logical circuit or the like.

Further, the technical elements explained in this specification or the drawings exhibit the technical usefulness independently or in accordance with various types of combinations, which are not limited to the combinations defined in claims at the time of the filing of the application. Further, the technique exemplified in this specification or the drawings simultaneously achieves a plurality of objects, and the technique has the technical usefulness intrinsically owing to the achievement of one of the objects.

What is claimed is:

1. A non-transitory computer-readable medium storing programs executable by a controller that causes a print execution device to execute printing, the print execution device including: a print head provided with nozzles aligned in a sub scanning direction; a holding member which holds a part of a printing medium conveyed from an upstream side toward a downstream side in the sub scanning direction; and a head driving device which causes the print head to execute a main scanning operation, the main scanning operation including an operation for causing the print head to discharge an ink toward the printing medium while moving the print head in a main scanning direction orthogonal to the sub scanning direction, the programs causing the controller to execute:

acquiring first object data which represents a first object image to be printed on a first sticky note; and generating printing data for the print execution device to execute the printing of the first object image on the first sticky note, which is conveyed in a state of being stuck on a mount, by utilizing the first object data, the printing data representing a printing image in which the first object image is arranged in a first predetermined area, the first predetermined area being an area in which the print execution device executes the printing of the first object image on the first sticky note only in a first state and does not execute the printing of the first object image on the first sticky note in a second state, the first state being a state in which the first sticky note is stuck on the mount and in which the mount and a part of the first sticky note are held by the holding member, the second state being a state in which the first sticky note is stuck on the mount and in which the mount is held by the holding member and the first sticky note is not held by the holding member, wherein the first predetermined area is an area which is specified by a size of the first sticky note, the number of the nozzles, a distance between the two nozzles adjoining in the sub scanning direction, and a size of the holding member.

2. The medium according to claim 1, wherein the first sticky note has a first sticky note end portion which has an adhesion area and a second sticky note end portion which is disposed on a side opposite to the first sticky note end portion in the sub scanning direction, the mount is conveyed in the sub scanning direction by the print execution device in a state in which the first sticky note is stuck so that the first sticky note end portion is positioned on the downstream side in the sub scanning direction and the second sticky note end portion is positioned on the upstream side in the sub scanning direction, and the holding member holds the first sticky note at a position disposed on the upstream side in the sub scanning direction as compared with the first sticky note end portion, under a condition that the print head executes the main scanning operation to print the first object image on the first sticky note.

3. The medium according to claim 1, wherein the holding member is a member which imparts, to the printing medium, such a wavy shape that protrusion portions protruding in a direction approaching to the print head and recess portions protruding in a direction separating away from the print head are alternately aligned in the main scanning direction, by holding the printing medium to be conveyed at a plurality of positions disposed in the main scanning direction.

4. The medium according to claim 1, wherein in the generating process, the controller generates the printing data so that, after a plurality of dots are formed to constitute the first object image on the first sticky note by executing the main scanning operation by the print head, another dot is not formed between two dots adjoining in the sub scanning direction of the plurality of dots and another dot is not formed between two dots adjoining in the main scanning direction of the plurality of dots.

5. The medium according to claim 1, wherein in the generating process, the controller generates the printing data so that, after a plurality of dots are formed to constitute the first object image on the first sticky note by executing the main scanning operation by the print head, another dot is formed in at least one of a space between two dots adjoining in the sub scanning direction of the plurality of dots and a space between two dots adjoining in the main scanning direction of the plurality of dots.

6. A non-transitory computer-readable medium storing programs executable by a controller that causes a print execution device to execute printing, the print execution device including: a print head provided with nozzles aligned in a sub scanning direction; a holding member which holds a part of a printing medium conveyed from an upstream side toward a downstream side in the sub scanning direction; and a head driving device which causes the print head to execute a main scanning operation, the main scanning operation including an operation for causing the print head to discharge an ink toward the printing medium while moving the print head in a main scanning direction orthogonal to the sub scanning direction, the programs causing the controller to execute:

acquiring first object data which represents a first object image to be printed on a first sticky note; and generating printing data for the print execution device to execute the printing of the first object image on the first sticky note, which is conveyed in a state of being stuck on a mount, by utilizing the first object data, the printing data representing a printing image in which the first object image is arranged in a first predetermined area, the first predetermined area being an area in which the print execution device executes the printing of the first object image on the first sticky note only in a first state and does not execute the printing of the first object image on the first sticky note in a second state, the first state being a state in which the first sticky note is stuck on the mount and in which the mount and a part of the first sticky note are held by the holding member, the second state being a state in which the first sticky note is stuck on the mount and in which the mount is held by the holding member and the first sticky note is not held by the holding member wherein the printing image has a first side which corresponds to the upstream side in the sub scanning direction and a second side which corresponds to the downstream side in the sub scanning direction, in relation to a first direction corresponding to the sub scanning direction, the printing image further includes a first predetermined image which is different from the first object image, the first predetermined image is arranged on the second side as compared with an end portion on the second side of the first object image, in relation to the first direction, and a distance between the first predetermined image and an end portion on the first side of the first object image in the first direction is a distance which is based on a distance between the two nozzles adjoining in the sub scanning direction and the number of times of the main scanning operation required for the print head to print the first object image on the first sticky note.

7. The medium according to claim 6, wherein the printing image further includes a second predetermined image which is different from the first object image, and the second predetermined image is arranged at a position different from that of the first object image in a second direction corresponding to the main scanning direction, and the second predetermined image is arranged in an area between the end portion on the first side of the first object image and the end portion on the second side of the first object image in the first direction.

8. A non-transitory computer-readable medium storing programs executable by a controller that causes a print execution device to execute printing, the print execution device including: a print head provided with nozzles aligned in a sub scanning direction; a holding member which holds a part of a printing medium conveyed from an upstream side toward a downstream side in the sub scanning direction; and a head driving device which causes the print head to execute a main scanning operation, the main scanning operation including an operation for causing the print head to discharge an ink toward the printing medium while moving the print head in a main scanning direction orthogonal to the sub scanning direction, the programs causing the controller to execute:

acquiring first object data which represents a first object image to be printed on a first sticky note; and generating printing data for the print execution device to execute the printing of the first object image on the first sticky note, which is conveyed in a state of being stuck on a mount, by utilizing the first object data, the printing data representing a printing image in which the first object image is arranged in a first predetermined area, the first predetermined area being an area in which the print execution device executes the printing of the first object image on the first sticky note only in a first state and does not execute the printing of the first object image on the first sticky note in a second state, the first state being a state in which the first sticky note is stuck on the mount and in which the mount and a part of the first sticky note are held by the holding member, the second state being a state in which the first sticky note is stuck on the mount and in which the mount is held by the holding member and the first sticky note is not held by the holding member wherein a second sticky note is further stuck to the mount, the mount is conveyed in the sub scanning direction by the print execution device in a state in which the first sticky note and the second sticky note are arranged at an identical position in the sub scanning direction and the first sticky note and the second sticky note are arranged at different positions in the main scanning direction, the programs cause the controller to further execute:

acquiring second object data which represents a second object image to be printed on the second sticky note, utilizing the second object data to generate the printing data for the print execution device to execute the printing of the second object image on the second sticky note, and controlling the print execution device to print the second object image on the second sticky note during a main scanning operation in which the holding member holds a part of the second sticky note, the second object image not being printed on the second sticky note during a main scanning operation in which the holding member does not hold the second sticky note.

9. A non-transitory computer-readable medium storing programs executable by a controller that causes a print execution device to execute printing, the print execution device including: a print head provided with nozzles aligned in a sub scanning direction; a holding member which holds a part of a printing medium conveyed from an upstream side toward a downstream side in the sub scanning direction; and a head driving device which causes the print head to execute a main scanning operation, the main scanning operation including an operation for causing the print head to discharge an ink toward the printing medium while moving the print head in a main scanning direction orthogonal to the sub scanning direction, the programs causing the controller to execute:

acquiring first object data which represents a first object image to be printed on a first sticky note; and generating printing data for the print execution device to execute the printing of the first object image on the first sticky note, which is conveyed in a state of being stuck on a mount, by utilizing the first object data, the printing data representing a printing image in which the first object image is arranged in a first predetermined area, the first predetermined area being an area in which the print execution device executes the printing of the first object image on the first sticky note only in a first state and does not execute the printing of the first object image on the first sticky note in a second state, the first state being a state in which the first sticky note is stuck on the mount and in which the mount and a part of the first sticky note are held by the holding member, the second state being a state in which the first sticky note is stuck on the mount and in which the mount is held by the holding member and the first sticky note is not held by the holding member, wherein the programs cause the controller to further execute a display process for displaying a mount image corresponding to the mount on a display, the mount image including an input area which is arranged in an area corresponding to the first predetermined area and to which the first object image is inputted, and in the first acquiring process, the controller acquires the first object data which represents the first object image inputted by a user into the input area in the mount image.

10. A non-transitory computer-readable medium storing programs executable by a controller that causes a print execution device to execute printing, the print execution device including: a print head provided with nozzles aligned in a sub scanning direction; a holding member which holds a part of a printing medium conveyed from an upstream side toward a downstream side in the sub scanning direction; and a head driving device which causes the print head to execute a main scanning operation, the main scanning operation including an operation for causing the print head to discharge an ink toward the printing medium while moving the print head in a main scanning direction orthogonal to the sub scanning direction, the programs causing the controller to execute:

acquiring first object data which represents a first object image to be printed on a first sticky note;

generating printing data for the print execution device to execute the printing of the first object image on the first sticky note by utilizing the first object data, the printing data representing a printing image in which the first object image is arranged in a first predetermined area;

supplying the printing data to the print execution device, controlling the print execution device to convey the first sticky note in a state of being stuck on a mount; and controlling the print execution device to print the first object image on the first sticky note during a main scanning operation in which the holding member holds a part of the first sticky note, the first object image not being printed on the first sticky note during a main scanning operation in which the holding member does not hold the first sticky note;

wherein the first predetermined area is an area which is specified by a size of the first sticky note, the number of the nozzles, a distance between the two nozzles adjoining in the sub scanning direction, and a size of the holding member.

* * * * *